US010324390B2

(12) United States Patent
Takeyama et al.

(10) Patent No.: US 10,324,390 B2
(45) Date of Patent: Jun. 18, 2019

(54) TONER, DEVELOPER, AND IMAGE FORMING APPARATUS

(71) Applicants: Akihiro Takeyama, Kanagawa (JP); Junichi Watanabe, Shizuoka (JP); Takahiro Kadota, Shizuoka (JP)

(72) Inventors: Akihiro Takeyama, Kanagawa (JP); Junichi Watanabe, Shizuoka (JP); Takahiro Kadota, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/884,559

(22) Filed: Jan. 31, 2018

(65) Prior Publication Data

US 2018/0259865 A1 Sep. 13, 2018

(30) Foreign Application Priority Data

Mar. 8, 2017 (JP) ..... 2017-043468
Dec. 21, 2017 (JP) ..... 2017-244894

(51) Int. Cl.
*G03G 9/097* (2006.01)
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/0825* (2013.01); *G03G 9/09716* (2013.01); *G03G 9/09766* (2013.01)

(58) Field of Classification Search
CPC ..... G03G 9/09766; G03G 9/09716; G03G 9/0825
USPC ..... 403/108.11
See application file for complete search history.

(56) References Cited

U.S. PATENT DOCUMENTS

| | | | | |
|---|---|---|---|---|
| 5,168,028 | A | 12/1992 | Nanya et al. | |
| 8,034,524 | B2 * | 10/2011 | Inoue | G03G 9/0821 430/109.4 |
| 2005/0277040 | A1 | 12/2005 | Michel et al. | |
| 2006/0020069 | A1 | 1/2006 | Michel et al. | |
| 2015/0261113 | A1 | 9/2015 | Takeyama et al. | |
| 2016/0187795 | A1 | 6/2016 | Saitoh et al. | |
| 2017/0363980 | A1 | 12/2017 | Nagata et al. | |

FOREIGN PATENT DOCUMENTS

| | | | | |
|---|---|---|---|---|
| JP | 63-109447 | | 5/1988 | |
| JP | 1-235959 | | 9/1989 | |
| JP | 3-213877 | | 9/1991 | |
| JP | 4-214570 | | 8/1992 | |
| JP | 6-348055 | | 12/1994 | |
| JP | 11-133665 | | 5/1999 | |
| JP | 2001-158819 | | 6/2001 | |
| JP | 2002-287400 | | 10/2002 | |
| JP | 2002-351143 | | 12/2002 | |
| JP | 2003-202708 | | 7/2003 | |
| JP | 2004-046095 | | 2/2004 | |
| JP | 2006-500605 | | 1/2006 | |
| JP | 2006-503313 | | 1/2006 | |
| JP | 2007-271789 | | 10/2007 | |
| JP | 2015-175998 | | 10/2015 | |
| WO | WO2004/019137 | A1 | 3/2004 | |
| WO | WO2004/019138 | A1 | 3/2004 | |
| WO | WO-2016103582 | A1 * | 6/2016 | C01B 33/40 |

* cited by examiner

*Primary Examiner* — Janis L Dote
(74) *Attorney, Agent, or Firm* — Oblon, McClelland, Maier & Neustadt, L.L.P.

(57) ABSTRACT

A toner is provided. The toner includes a resin and a fluorine-containing component. The toner satisfies the following formula:

$$5.0 \leq F_{XPS}/F_{XRF} \leq 25.0$$

where $F_{XPS}$ (atomic %) represents a content rate of fluorine atom in the toner determined by X-ray photoelectron spectroscopy (XPS) and $F_{XRF}$ (weight %) represents another content rate of fluorine atom in the toner determined by X-ray fluorescence analysis (XRF).

18 Claims, 4 Drawing Sheets

TONER, DEVELOPER, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2017-043468 and 2017-244894, filed on Mar. 8, 2017 and Dec. 21, 2017, respectively, in the Japan Patent Office, the entire disclosure of each of which is hereby incorporated by reference herein.

BACKGROUND

Technical Field

The present disclosure relates to a toner, a developer, and an image forming apparatus.

Description of the Related Art

Recently, toner has been required to have a small particle size for higher image quality, to have high-temperature offset resistance, to have low-temperature fixability for energy saving, and to have heat-resistant storage stability to be resistant to high temperatures and high humidities when stored or transported. Since most of the power consumption during an image forming process is used for fixing toner on a recording medium, it is effective to improve low-temperature fixability in terms of energy saving.

Conventionally, toners produced by kneading and pulverization processes ("pulverization toners") have been widely used. Since it is generally difficult to reduce the particle size of pulverization toners, toners produced by polymerization processes ("polymerization toners") have also been proposed.

Various toner production processes have been proposed for achieving satisfactory levels of thermal properties such as heat-resistant storage stability, low-temperature fixability, and high-temperature offset resistance.

In attempting to achieve a high level of low-temperature fixability, one proposed toner contains a crystalline polyester resin and a release agent that are incompatible with each other and forming a sea-island phase separation structure in the toner.

On the other hand, in attempting to impart negative chargeability to toner, a pulverization toner containing a fluorine-based compound as a charge controlling agent has been proposed.

However, it is generally difficult to contain such a charge controlling agent in a toner produced by a process using an aqueous medium.

SUMMARY

In accordance with some embodiments of the present invention, a toner is provided. The toner includes a resin and a fluorine-containing component. The toner satisfies the following formula:

$$5.0 \leq F_{XPS}/F_{XRF} \leq 25.0$$

where $F_{XPS}$ (atomic %) represents a content rate of fluorine atom in the toner determined by X-ray photoelectron spectroscopy (XPS) and $F_{XRF}$ (weight %) represents another content rate of fluorine atom in the toner determined by X-ray fluorescence analysis (XRF).

In accordance with some embodiments of the present invention, a developer is provided. The developer includes the above toner and a carrier.

In accordance with some embodiments of the present invention, an image forming apparatus is provided. The image forming apparatus includes an electrostatic latent image bearer; an electrostatic latent image forming device configured to form an electrostatic latent image on the electrostatic latent image bearer; and a developing device containing the above toner, configured to develop the electrostatic latent image on the electrostatic latent image bearer into a toner image with the toner.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
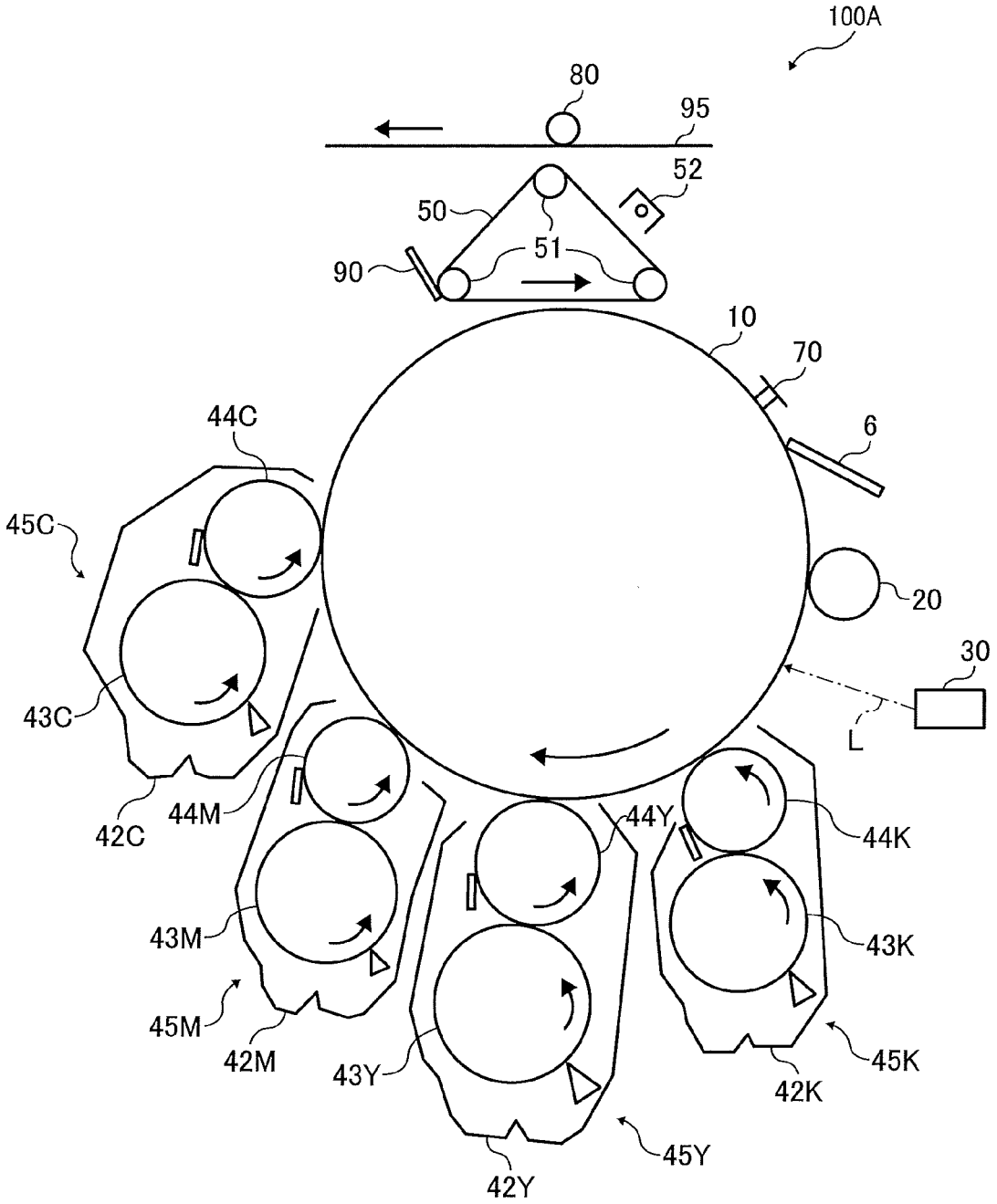
FIG. 1 is a schematic view of an image forming apparatus in accordance with some embodiments of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner having excellent low-temperature fixability, heat-resistant storage stability, and charging stability is provided.

Toner

The toner in accordance with some embodiments of the present invention satisfies the following formula: $5.0 \leq F_{XPS}/F_{XRF} \leq 25.0$, where $F_{XPS}$ (atomic %) represents a content rate of fluorine atom in the toner determined by X-ray photoelectron spectroscopy (XPS) and $F_{XRF}$ (weight %) represents another content rate of fluorine atom in the toner determined by X-ray fluorescence analysis (XRF).

Due to this property, the toner has excellent low-temperature fixability, heat-resistant storage stability, and charging stability.

The ratio ($F_{XPS}/F_{XRF}$) is in the range of from 5.0 to 25.0, preferably from 6.0 to 15.0. When the ratio ($F_{XPS}/F_{XRF}$) is in excess of 25.0, fluorine-containing components (e.g., fluorine-containing compound) deposited on the surface of the toner inhibit fixation of the toner, resulting in deterioration of low-temperature fixability of the toner. When the ratio ($F_{XPS}/F_{XRF}$) is less than 5.0, fluorine-containing components deposited on the surface of the toner are too small in amount, resulting in deterioration of charging property of the toner.

In toner analysis, generally, XPS is used for surface analysis and XRF is used for bulk analysis. The ratio ($F_{XPS}/F_{XRF}$) indicates information on arrangement of fluorine-containing components in toner.

The ratio ($F_{XPS}/F_{XRF}$) can be controlled by varying the structure or content of the fluorine-containing components (e.g., a fluorine-containing compound serving as a charge controlling agent) in the toner.

For example, the ratio ($F_{XPS}/F_{XRF}$) can be adjusted to within the preferred range of from 5.0 to 25.0 by containing a fluorine-modified layered inorganic mineral in the toner, but the toner in accordance with some embodiments of the present invention is not limited thereto. As long as the inventors of the present invention have studied, a toner satisfying the formula $5.0 \leq F_{XPS}/F_{XRF} \leq 25.0$ has never been obtained by producing the toner using a fluorine-based surfactant.

The content rate ($F_{XRF}$ (weight %)) of fluorine atom in the toner determined by X-ray fluorescence analysis (XRF) is preferably in the range of from 0.02 to 0.07 weight %, more preferably from 0.02 to 0.03 weight %. When $F_{XRF}$ (weight %) is in this preferred range, charging stability and low-temperature fixability are good.

The content rate ($F_{XPS}$ (atomic %)) of fluorine atom in the toner determined by X-ray photoelectron spectroscopy (XPS) is preferably in the range of from 0.2 to 0.8 atomic %, more preferably from 0.2 to 0.3 atomic %. When $F_{XPS}$ (atomic %) is in this preferred range, charge rising property ("TA15") is good.

Preferably, the toner contains a fluorine-modified layered inorganic mineral. The toner may further contain a resin such as polyester resin. The toner may further optionally contain other components.

Fluorine-Modified Layered Inorganic Mineral

One method for adjusting the ratio ($F_{XPS}/F_{XRF}$) within the range of from 5.0 to 25.0 involves containing a layered inorganic mineral, the surface of which is treated with a fluorine-containing compound (hereinafter "fluorine-modified layered inorganic mineral").

Layered Inorganic Mineral

In the present disclosure, a layered inorganic mineral refers to an inorganic mineral formed of laminated layers each having a thickness of several nanometers. "Modification" refers to introduction of organic ions into the ions present between the layers. "Modification" is also referred to as "intercalation" in the broad sense. Examples of organic-cation-modified layered inorganic minerals are described in, for example, JP-2003-202708-A. Examples of layered inorganic minerals include smectite families (e.g., montmorillonite and saponite), kaolin families (e.g., kaolinite), magadiite, and kanemite. Examples of organic-anion-modified layered inorganic mineral are described in, for example, JP-2006-500605-A and JP-2006-503313-A. As an example of the organic-anion-modified layered inorganic minerals, an organic-anion-modified hydrotalcite, that is a layered double hydroxide, is known. Modified layered inorganic minerals have high hydrophilicity due to their modified layered structure. When an unmodified layered inorganic mineral is used as a raw material of a toner that is produced through the processes of dispersion and granulation in an aqueous medium, the layered inorganic mineral migrates to the aqueous medium without making the toner shape irregular. On the other hand, an organic-ion-modified layered inorganic mineral has proper degree of hydrophobicity and can be present near the surface of the toner in large amounts, thus easily making the toner shape irregular in the process of granulation. In addition, the modified layered inorganic mineral can be finely dispersed in the toner, thus sufficiently exerting charge adjustment function. The modified layered inorganic mineral contributes little to fixation of the toner at low temperatures. In case the modified layered inorganic mineral is present at the surface of the toner in large amounts, fixation of the toner may be inhibited at low temperatures. Since the modified layered inorganic mineral is capable of making the toner shape irregular and exerting charge adjustment function with a very small amount, it is possible to simultaneously achieve shape control, charge adjustment, and low-temperature fixing.

In the present disclosure, an organic-cation-modified layered inorganic mineral having a smectite-based crystalline structure is preferably used. Smectite-family clay minerals generally comprise negatively-charged layers and counter cations present between the layers. An interlayer compound may be formed by ion exchange of the cations or adsorption of polar molecules. By substituting a part of divalent metals in the layered inorganic mineral with trivalent metals, metallic ions can be introduced. Since metallic ions have high hydrophilicity, it is preferable that at least part of the metallic ions is modified with an organic anion. Such a layered inorganic mineral has proper degree of hydrophobicity.

Preferred examples of organic ion modifying agents for modifying at least part of ions in the layered inorganic mineral with an organic ion include quaternary alkylammonium salts, phosphonium salts, and imidazolium salts. Among these, quaternary alkylammonium salts are most preferable. Specific examples of the quaternary alkylammonium include, but are not limited to, trimethylstearylammonium, dimethylstearylbenzylammonium, dimethyloctadecylammonium, and oleylbis(2-hydroxyethyl) methylammonium.

Specific examples of the layered inorganic mineral to be modified include, but are not limited to, kaolinite, layered phosphate, and layered double oxides. The organic ion modifying agent can be appropriately selected according to the electric charge of the layers. When the layers have negative charge, the above-described organic ion modifying agents are preferably used. When the layers have positive charge, sulfates, sulfonates, carboxylates, and phosphates each having a branched, non-branched, or cyclic alkyl (C1-C44), alkenyl (C2-C22), alkoxy (C8-C32), hydroxyalkyl (C2-C22), ethylene oxide, or propylene oxide are preferably used. In particular, carboxylate having ethylene oxide backbone is preferable.

By modifying at least part of a layered inorganic mineral with an organic ion, the resulting modified layered inorganic mineral has proper degree of hydrophobicity. An oil phase comprising toner constituents and/or toner constituent precursors including such a layered inorganic mineral has a non-Newtonian viscosity and the resulting toner has an irregular shape. The content rate of the modified layered inorganic mineral, at least part of which is modified with an organic ion, in the toner constituents is preferably from 0.05% to 10% by mass, more preferably from 0.05% to 5% by mass. Here, the toner constituents refer to materials constituting the toner, and the toner constituent precursor refers to materials becoming the toner constituents by a reaction.

Specific examples of the modified layered inorganic mineral at least part of which is modified with an organic ion include, but are not limited to, montmorillonite, bentonite, hectorite, attapulgite, sepiolite, and mixtures thereof. Among these, organic-modified montmorillonite and bentonite are preferable because they are capable of easily controlling viscosity with a small amount without adversely affecting toner properties.

Specific examples of commercially-available products of modified layered inorganic minerals at least part of which is modified with an organic cation include, but are not limited to; quaternium-18 bentonite (e.g., BENTONE® 3, BENTONE® 38, and BENTONE® 38V (available from Elementis Specialties); TIXOGEL VP (available from BYK Additives & Instruments); and CLAYTONE® 34, CLAYTONE® 40, and CLAYTONE® XL (available from BYK Additives & Instruments)); stearalkonium bentonite (e.g., BENTONE® 27 (available from Elementis Specialties); TIXOGEL LG (available from BYK Additives & Instruments); and CLAYTONE® AF and CLAYTONE® APA (available from BYK Additives & Instruments)); and quaternium-18/benzalkonium bentonite (e.g., CLAYTONE® HT and CLAYTONE® PS (available from BYK Additives & Instruments)). Among these, CLAYTONE® AF and CLAYTONE® APA are preferable. Specific examples of modified layered inorganic minerals at least part of which is modified with an organic anion include, but are not limited to, DHT-4A (available from Kyowa Chemical Industry Co., Ltd.) modified with an organic anion represented by the following formula (1). Specific examples of the organic anion represented by the formula (1) include HITENOL 330T (available from DKS Co., Ltd.).

$$R_1(OR_2)_nOSO_3M \qquad \text{Formula (1)}$$

In the formula (1), $R_1$ represents an alkyl group having 13 carbon atoms, $R_2$ represents an alkylene group having 2 to 6 carbon atoms, n represents an integer of from 2 to 10, and M represents a monovalent metal element.

The modified layered inorganic mineral has proper degree of hydrophobicity. An oil phase comprising toner constituents and/or toner constituent precursors including such a modified layered inorganic mineral exhibits a non-Newtonian viscosity in the process of producing the toner and the resulting toner has an irregular shape. In addition, the modified layered inorganic mineral exhibits chargeability due to the presence of organic ions. Thus, the toner exhibits sufficient chargeability when the modified layered inorganic mineral is present at the surface thereof in large amounts.

Fluorine-Containing Compound

Preferably, the fluorine-containing compound for modifying layered inorganic minerals has a fluoroalkyl group. Preferred examples of the fluorine-containing compound include coupling agents having a fluoroalkyl group.

Preferably, the fluorine-modified layered inorganic mineral is obtained by surface-modifying the layered inorganic mineral with a coupling agent having a fluoroalkyl group. Examples of such a coupling agent include, but are not limited to, silane coupling agents, alumina coupling agents, and titanate coupling agents. Specific examples of such coupling agents include, but are not limited to, inorganic and organic salts of Si, Al, or Ti and organic compounds having at least one hydrophobic alkoxyl group such as an alkylalkoxyl group. Among these, silane coupling agents are preferable.

Specific preferred examples of the silane coupling agents include those represented by the following formula (2).

$$RaSiRb_3 \qquad \text{Formula (2)}$$

In the formula (2), Ra represents a hydrocarbon group that has fluoromethyl group and may have a functional group, and Rb represents a hydrolyzable group or hydroxyl group.

In the silane coupling agent represented by the formula (2), Ra represents a hydrocarbon group having fluoromethyl group. Specific examples of the hydrocarbon group include, but are not limited to, aliphatic, aromatic, and alicyclic hydrocarbon groups that may be either straight-chain or branched-chain and either saturated or unsaturated. The hydrocarbon group may be either monovalent or polyvalent.

The number of carbon atoms in the aliphatic hydrocarbon group is preferably 1 to 25, more preferably 1 to 3. The number of carbon atoms in the aromatic hydrocarbon group is preferably 6 to 25, more preferably 6 to 10. The number of carbon atoms in the alicyclic hydrocarbon group is preferably 3 to 25, more preferably 3 to 6.

In the silane coupling agent represented by the formula (2), Rb represents a hydrolyzable group or hydroxyl group. Specific examples of the hydrolyzable group include, but are not limited to, alkoxy group, alkenyloxy group, ketoxime group, acyloxy group, amino group, aminooxy group, amide group, and halogen atom.

Specific examples of the silane coupling agent represented by the formula (2) include, but are not limited to, trifluoromethyl trimethoxysilane, 2,2,2-trifluoroethyl trimethoxysilane, 3,3,3-trifluoropropyl trimethoxysilane, trifluoromethyl triethoxysilane, 2,2,2-trifluoroethyl triethoxysilane, 3,3,3-trifluoropropyl triethoxysilane, 2-ethyl-6,6,6-trifluorohexyl trimethoxysilane, 2-hexenyl-5,5,5-trifluorotrimethoxysilane, and p-trifluoromethylphenyl trimethoxysilane.

Each of these coupling agents may be used alone or in combination with others.

By treating the layered inorganic mineral with the coupling agent, the surface thereof is covered with a fluorine compound having high polarity. By adding such a modified layered inorganic mineral to the toner, the toner exhibits a high level of chargeability.

How to treat the layered inorganic mineral with the coupling agent is not limited. For example, the layered inorganic mineral may be treated with the coupling agent by adding the coupling agent to a slurry of the layered inorganic mineral to cause hydrolysis of the coupling agent, filtering solid matter from the slurry, and heating the solid matter to condense the hydrolysis product of the coupling agent.

For adjusting the ratio ($F_{XPS}/F_{XRF}$) to within the range of from 5.0 to 25.0 when the fluorine-modified layered inorganic mineral is used, the content of the fluorine-containing compound in the fluorine-modified layered inorganic mineral is preferably from 2 to 50 parts by mass, more preferably from 4 to 40 parts by mass, based on 100 parts by mass of the layered inorganic mineral. When the content is 2 parts by mass or greater, the ratio ($F_{XPS}/F_{XRF}$) is unlikely to exceed 25.0. When the content is 50 parts by mass or less, the ratio ($F_{XPS}/F_{XRF}$) is unlikely to fall below 5.0. When the content is within the preferred range, image quality and low-temperature fixability are all excellent.

The content rate of the fluorine-modified layered inorganic mineral in the toner is preferably from 0.5% to 2.0% by mass, more preferably from 0.7% to 1.5% by mass, and most preferably from 0.9% to 1.3% by mass.

Polyester Resin

Examples of the polyester resin include, but are not limited to, a non-linear amorphous polyester resin A, an amorphous polyester resin B, and a crystalline polyester resin C.

Non-linear Amorphous Polyester Resin A

Preferred examples of the non-linear amorphous polyester resin A include, but are not limited to, a reaction product of a non-linear reactive precursor and a curing agent.

The non-linear amorphous polyester resin A may become THF-insoluble matter in the toner.

Preferably, the non-linear amorphous polyester resin A has urethane bond and/or urea bond for exhibiting excellent adhesion property to recording media such as paper. When included in the non-linear amorphous polyester resin A, urethane bond and/or urea bond behave as pseudo cross-linked points, thereby enhancing rubber property of the non-linear amorphous polyester resin A. Thus, the toner can be improved in heat-resistant storage stability and high-temperature offset resistance.

Being non-linear refers to having a branched structure formed with an alcohol having 3 or more valences and/or a carboxylic acid having 3 or more valences.

Non-linear Reactive Precursor

The non-linear reactive precursor is a polyester resin having a group reactive with the curing agent (hereinafter "prepolymer").

Examples of the group reactive with the curing agent include, but are not limited to, a group reactive with an active hydrogen group. Specific examples of the group reactive with an active hydrogen group include, but are not limited to, isocyanate group, epoxy group, carboxylic acid group, and an acid chloride group. Among these groups, isocyanate group is preferable because of being capable of introducing urethane bond and/or urea bond to the amorphous polyester resin A.

The prepolymer is non-linear. Being non-linear refers to having a branched structure formed with at least one of an alcohol having 3 or more valences and a carboxylic acid having 3 or more valences.

Preferably, the prepolymer is a polyester resin having an isocyanate group.

Polyester Resin Having Isocyanate Group

Examples of the polyester resin having an isocyanate group include, but are not limited to, a reaction product of a polyester resin having an active hydrogen group with a polyisocyanate.

The polyester resin having an active hydrogen group may be obtained by condensation-polymerizing a diol, a dicarboxylic acid, and at least one of an alcohol having 3 or more valences and a carboxylic acid having 3 or more valences. The alcohol having 3 or more valences and the carboxylic acid having 3 or more valences impart a branched structure to the resultant polyester resin having an isocyanate group.

Diol

Specific examples of the diol include, but are not limited to: aliphatic diols such as ethylene glycol, 1,2-propylene glycol, 1,3-propylene glycol, 1,4-butanediol, 3-methyl-1,5-pentanediol, 1,6-hexanediol, 1,8-octanediol, 1,10-decanediol, and 1,12-dodecanediol; oxyalkylene-group-containing diols such as diethylene glycol, triethylene glycol, dipropylene glycol, polyethylene glycol, polypropylene glycol, and polytetramethylene glycol; alicyclic diols such as 1,4-cyclohexanedimethanol and hydrogenated bisphenol A; alkylene oxide (e.g., ethylene oxide, propylene oxide, and butylene oxide) adducts of alicyclic diols; bisphenols such as bisphenol A, bisphenol F, and bisphenol S; and alkylene oxide (e.g., ethylene oxide, propylene oxide, and butylene oxide) adducts of bisphenols. Among these, aliphatic diols having 4 to 12 carbon atoms are preferable.

Each of these diols can be used alone or in combination with others.

Dicarboxylic Acid

Specific examples of the dicarboxylic acid include, but are not limited to, aliphatic dicarboxylic acids and aromatic dicarboxylic acids. In addition, anhydrides, lower alkyl (C1-C3) esters, and halides thereof may also be used.

Specific examples of the aliphatic dicarboxylic acids include, but are not limited to, succinic acid, adipic acid, sebacic acid, dodecanedioic acid, maleic acid, and fumaric acid.

Specific preferred examples of the aromatic dicarboxylic acids include those having 8 to 20 carbon atoms. Specific examples of the aromatic dicarboxylic acids having 8 to 20 carbon atoms include, but are not limited to, phthalic acid, isophthalic acid, terephthalic acid, and naphthalene dicarboxylic acids.

Among these, aliphatic dicarboxylic acids having 4 to 12 carbon atoms are preferable.

Each of these dicarboxylic acids can be used alone or in combination with others.

Alcohol Having 3 or More Valences

Specific examples of the alcohol having 3 or more valences include, but are not limited to, aliphatic alcohols having 3 or more valences, polyphenols having 3 or more valences, and alkylene oxide adducts of polyphenols having 3 or more valences.

Carboxylic Acid Having 3 or More Valences

Specific examples of the carboxylic acid having 3 or more valences include, but are not limited to, aromatic carboxylic acids having 3 or more valences. In addition, anhydrides, lower alkyl (C1-C3) esters, and halides thereof may also be used.

Polyisocyanate

Specific examples of the polyisocyanate include, but are not limited to, diisocyanates and isocyanates having 3 or more valences.

Each of these polyisocyanates can be used alone or in combination with others.

Curing Agent

The curing agent has no limit so long as being reactive with the non-linear reactive precursor to produce the non-linear amorphous polyester resin A. Specific examples of such a curing agent include, but are not limited to, compounds having an active hydrogen group.

Compound having Active Hydrogen Group

Specific examples of the active hydrogen group in the compound include, but are not limited to, hydroxyl groups (e.g., alcoholic hydroxyl group and phenolic hydroxyl group), amino group, carboxyl group, and mercapto group. Each of these active hydrogen groups may be included in the compound alone or in combination with others.

Preferably, the compound having an active hydrogen group is an amine, because amines are capable of forming urea bond.

Preferably, the non-linear amorphous polyester resin A satisfies at least one of the following items (a) to (c) for the purpose of reducing its glass transition temperature (Tg) and becoming more easily deformable at low temperatures.

(a) Comprising diol components, and 50% by mass or more of the diol components are aliphatic diols having 4 to 12 carbon atoms.

(b) 50% by mass or more of all the alcohol components are aliphatic diols having 4 to 12 carbon atoms.

(c) Comprising dicarboxylic acid components, and 50% by mass or more of the dicarboxylic acid components are aliphatic dicarboxylic acids having 4 to 12 carbon atoms.

The non-linear amorphous polyester resin A preferably has a glass transition temperature of from −60° C. to 0° C., more preferably from −40° C. to −20° C. When the glass transition temperature is within the above range, the following undesired phenomena can be prevented.

Deterioration of heat-resistant storage stability caused because toner flow cannot be suppressed at low temperatures.

Deterioration of filming resistance.

Insufficient low-temperature fixability caused by insufficient deformation of the toner even when being heated and pressurized in the fixing process.

The non-linear amorphous polyester resin A preferably has a weight average molecular weight of from 20,000 to 1,000,000 when measured by GPC (gel permeation chromatography). The weight average molecular weight of the non-linear amorphous polyester resin A is that of the reaction product of the non-linear reactive precursor and the curing agent. When the weight average molecular weight is within the above range, the following undesired phenomena can be prevented.

Deterioration of heat-resistant storage stability caused because toner becomes more easily flowable at low temperatures.

Deterioration of high-temperature offset resistance caused because viscosity is lowered at the time the toner melts.

The molecular structure of the non-linear amorphous polyester resin A can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect an amorphous polyester resin as a substance showing no absorption peak based on δCH (out-of-plane bending vibration) of olefin at 965±10 $cm^{-1}$ or 990±10 $cm^{-1}$ in an infrared absorption spectrum.

The content of the non-linear amorphous polyester resin A in 100 parts by mass of the toner is preferably in the range of from 5 to 25 parts by mass, more preferably from 10 to 20 parts by mass. When the content is within the above range, the following undesired phenomena can be prevented.

Deterioration of low-temperature fixability and high-temperature offset resistance.

Deterioration of heat-resistant storage stability and lowering of gloss value of the fixed image.

When the content is within the preferred range, low-temperature fixability, high-temperature offset resistance, and heat-resistant storage stability are all excellent.

Amorphous Polyester Resin B

The non-linear amorphous polyester resin B has no limit so long as having a glass transition temperature (Tg) of from 40° C. to 80° C.

Preferably, the amorphous polyester resin B is a linear polyester resin.

Preferably, the modified polyester resin B is an unmodified polyester resin. Here, the unmodified polyester resin refers to a polyester resin that is obtained from a polyol and a polycarboxylic acid or derivative thereof (e.g., a polycarboxylic acid anhydride and a polycarboxylic acid ester) and that is unmodified with isocyanate compound, etc.

Examples of the polyol include, but are not limited to, diols.

Specific examples of the diols include, but are not limited to, alkylene (C2-C3) oxide adducts of bisphenol A with an average addition molar number of 1 to 10 (e.g., polyoxypropylene(2.2)-2,2-bis(4-hydroxyphenyl)propane and polyoxyethylene(2.2)-2,2-bis(4-hydroxyphenyl)propane), ethylene glycol, propylene glycol, hydrogenated bisphenol A, and alkylene (C2-C3) oxide adducts of hydrogenated bisphenol A with an average addition molar number of 1 to 10.

Each of these diols can be used alone or in combination with others.

Examples of the polycarboxylic acid include, but are not limited to, dicarboxylic acids.

Specific examples of the dicarboxylic acids include, but are not limited to: adipic acid, phthalic acid, isophthalic acid, terephthalic acid, fumaric acid, and maleic acid; and succinic acid derivatives substituted with an alkyl group having 1 to 20 carbon atoms or an alkenyl group having 2 to 20 carbon atoms, such as dodecenyl succinic acid and octyl succinic acid.

Each of these dicarboxylic acids can be used alone or in combination with others.

The amorphous polyester resin B may contain at least one of a carboxylic acid having 3 or more valences and an alcohol having 3 or more valences at a terminal of the resin chain, for the purpose of adjusting acid value and/or hydroxyl group.

Specific examples of the carboxylic acid having 3 or more valences include, but are not limited to, trimellitic acid, pyromellitic acid, and anhydrides thereof.

Specific examples of the alcohol having 3 or more valences include, but are not limited to, glycerin, pentaerythritol, and trimethylolpropane.

The amorphous polyester resin B is not limited in molecular weight. However, if the molecular weight is too low, heat-resistant storage stability and durability (i.e., resistance to stresses, such as that caused by stirring in a developing device) of the toner will deteriorate. If the molecular weight is too high, viscoelasticity of the toner will be so high when the toner is melted that low-temperature fixability will be degraded. Therefore, the weight average molecular weight (Mw) is preferably from 3,000 to 10,000 when measured by GPC (gel permeation chromatography). The number average molecular weight (Mn) is preferably from 1,000 to 4,000. The ratio Mw/Mn is preferably from 1.0 to 4.0.

More preferably, the weight average molecular weight (Mw) is from 4,000 to 7,000. More preferably, the number average molecular weight (Mn) is from 1,500 to 3,000. More preferably, the ratio Mw/Mn is from 1.0 to 3.5.

The amorphous polyester resin B preferably has an acid value of from 1 to 50 mgKOH/g, more preferably from 5 to 30 mgKOH/g. When the acid value is 1 mgKOH/g or more, the toner becomes more negatively-chargeable and more compatible with paper when being fixed thereon, improving low-temperature fixability.

The amorphous polyester resin B preferably has a hydroxyl value of 5 mgKOH/g or more.

The amorphous polyester resin B preferably has a glass transition temperature (Tg) of from 40° C. to 80° C., more preferably from 50° C. to 70° C. When the glass transition temperature is within the above range, the following undesired phenomena can be prevented.

Deterioration of heat-resistant storage stability and durability (resistance to stress caused by stirring in a developing device) of the toner.

Deterioration of filming resistance.

Insufficient low-temperature fixability caused by insufficient deformation of the toner even when being heated and pressurized in the fixing process.

The molecular structure of the amorphous polyester resin B can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect an amorphous polyester resin as a substance showing no absorption peak based on δCH (out-of-plane bending vibration) of olefin at 965±10 $cm^{-1}$ or 990±10 $cm^{-1}$ in an infrared absorption spectrum.

The content of the amorphous polyester resin B in 100 parts by mass of the toner is preferably in the range of from 50 to 90 parts by mass, more preferably from 60 to 80 parts by mass. When the content is within the above range, the following undesired phenomena can be prevented.

Occurrence of image fog or image distortion caused by deterioration of dispersibility of colorants and release agents in the toner.

Deterioration of low-temperature fixability caused by lower contents of the crystalline polyester resin C and the non-linear amorphous polyester resin A.

When the content is within the preferred range, image quality and low-temperature fixability are all excellent.

Crystalline Polyester Resin C

The crystalline polyester resin C has a heat melting property such that the viscosity rapidly decreases at around the fixing start temperature due to its high crystallinity. When used in combination with the amorphous polyester resin B, the crystalline polyester resin C can maintain good storage stability below the melting start temperature due to its crystallinity, but upon reaching the melting start temperature, the crystalline polyester resin C melts while rapidly reducing its viscosity ("sharply-melting property"). The crystalline polyester resin C then compatibilizes with the amorphous polyester resin B and together rapidly reduces viscosity to be fixed on a recording medium. Thus, the toner exhibits excellent heat-resistant storage stability and low-temperature fixability. Such a toner also exhibits a wide releasable range (i.e., the difference between the lowest fixable temperature and the high-temperature offset generating temperature).

The crystalline polyester resin C is obtained from a polyol and a polycarboxylic acid or derivative thereof, such as a polycarboxylic acid anhydride and a polycarboxylic acid ester.

In the present disclosure, the crystalline polyester resin C refers to a resin obtained from a polyol and a polycarboxylic acid or derivative thereof, such as a polycarboxylic acid anhydride and a polycarboxylic acid ester. Modified polyester resins, such as the prepolymer described above and resins obtained by cross-linking and/or elongating the prepolymer, do not fall within the crystalline polyester resin C of the present disclosure.

Polyol

Examples of the polyol include, but are not limited to, diols and alcohols having 3 or more valences.

Examples of the diols include, but are not limited to, saturated aliphatic diols. Examples of the saturated aliphatic diols include, but are not limited to, straight-chain saturated aliphatic diols and branched saturated aliphatic diols. In particular, straight-chain saturated aliphatic diols are preferable, and straight-chain saturated aliphatic diols having 2 to 12 carbon atoms are more preferable.

Each of these compounds can be used alone or in combination with others.

Polycarboxylic Acid

Examples of the polycarboxylic acid include, but are not limited to, dicarboxylic acids and carboxylic acids having 3 or more valences.

Examples of the dicarboxylic acid include, but are not limited to, saturated aliphatic dicarboxylic acids, aromatic dicarboxylic acids, dicarboxylic acids having sulfonic acid group, and dicarboxylic acids having a double bond.

Each of these compounds can be used alone or in combination with others.

Preferably, the crystalline polyester resin C comprises a straight-chain saturated aliphatic dicarboxylic acid having 4 to 12 carbon atoms and a straight-chain saturated aliphatic diol having 2 to 12 carbon atoms. In other words, preferably, the crystalline polyester resin C has a structural unit derived from a saturated aliphatic dicarboxylic acid having 4 to 12 carbon atoms and another structural unit derived from a saturated aliphatic diol having 2 to 12 carbon atoms. Such a crystalline polyester resin has high crystallinity and sharply-melting property and thus exerts excellent low-temperature fixability.

Preferably, the melting point of the crystalline polyester resin C is in the range of from 60° C. to 80° C., but is not limited thereto. When the melting point is within the above range, the following undesired phenomena can be prevented.

Deterioration of heat-resistant storage stability of the toner caused because the crystalline polyester resin C easily melts at low temperatures.

Deterioration of low-temperature fixability caused by insufficient melting of the crystalline polyester resin C even when being heated in the fixing process.

The molecular weight of the crystalline polyester resin C is not limited to any particular value. As the molecular weight distribution becomes narrower and the molecular weight becomes lower, low-temperature fixability is improved. If low-molecular-weight components exist in large amounts, heat-resistant storage stability will deteriorate. In view of this, preferably, ortho-dichlorobenzene-soluble matter in the crystalline polyester resin C has a weight average molecular weight (Mw) of from 3,000 to 30,000 and a number average molecular weight (Mn) of from 1,000 to 10,000, and a ratio Mw/Mn is of from 1.0 to 10, when measured by GPC (gel permeation chromatography).

More preferably, the weight average molecular weight (Mw) is from 5,000 to 15,000, the number average molecular weight (Mn) is from 2,000 to 10,000, and the ratio Mw/Mn is from 1.0 to 5.0.

Preferably, the acid value of the crystalline polyester resin C is 5 mgKOH/g or more, more preferably 10 mgKOH/g or more, for achieving a desired level of low-temperature fixability in terms of affinity for paper, but is not limited thereto. On the other hand, for improving high-temperature offset resistance, the acid value is preferably 45 mgKOH/g or less.

Preferably, the hydroxyl value of the crystalline polyester resin C is in the range of from 0 to 50 mgKOH/g, more preferably from 5 to 50 mgKOH/g, for achieving a desired level of low-temperature fixability and a good level of charge property, but is not limited thereto.

The molecular structure of the crystalline polyester resin C can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a crystalline polyester resin as a substance showing an absorption peak based on δCH (out-of-plane bending vibration) of olefin at 965±10 $cm^{-1}$ or 990±10 $cm^{-1}$ in an infrared absorption spectrum.

Preferably, the content of the crystalline polyester resin C in 100 parts by mass of the toner is in the range of from 3 to 20 parts by mass, more preferably from 5 to 15 parts by mass. When the content is within the above range, the following undesired phenomena can be prevented.

- Deterioration of low-temperature fixability caused because sharply-melting property of the crystalline polyester resin C sharply melts is insufficient.
- Occurrence of image fog or image distortion caused by deterioration of heat-resistant storage stability.

When the content is within the preferred range, image quality and low-temperature fixability are all excellent.

Other Constituents

The toner may further comprise other constituents such as a release agent, a colorant, an external additive, a fluidity improving agent, a cleanability improving agent, and a magnetic material.

Release Agent

The release agent is not limited to any particular material and selected from known materials.

Preferably, the melting point of the release agent is in the range of from 60° C. to 80° C., but is not limited thereto.

Preferably, the content of the release agent in 100 parts by mass of the toner is in the range of from 2 to 10 parts by mass, more preferably from 3 to 8 parts by mass.

Colorant

The colorant is not limited to any particular material and selected according to the purpose.

Preferably, the content of the colorant in 100 parts by mass of the toner is in the range of from 1 to 15 parts by mass, more preferably from 3 to 10 parts by mass.

The colorant can be combined with a resin to be used as a master batch.

External Additive

Specific examples of usable external additives include, but are not limited to, oxide fine particles, inorganic fine particles, and hydrophobized inorganic fine particles, and combinations thereof. In particular, hydrophobized inorganic fine particles, the primary particles of which having an average particle diameter of from 1 to 100 nm, more preferably from 5 to 70 nm, are preferable.

More preferably, the external additive includes at least one type of hydrophobized inorganic fine particle the primary particles of which having an average particle diameter of 20 nm or less, and at least one type of inorganic fine particle the primary particles of which having an average particle diameter of 30 nm or more. Preferably, the BET specific surface area of the external additive is from 20 to 500 $m^2/g$.

Preferably, the content of the external additive in 100 parts by mass of the toner is in the range of from 0.1 to 5 parts by mass, more preferably from 0.3 to 3 parts by mass.

Preferably, the average particle diameter of the primary particles of the inorganic fine particle is 100 nm or less, more preferably in the range of from 3 to 70 nm, but is not limited thereto.

Fluidity Improving Agent

The fluidity improving agent refers to a toner surface treatment agent that improves hydrophobicity of the toner to prevent deterioration of fluidity and chargeability of the toner even under high-humidity environments. Specific examples of the fluidity improving agent include, but are not limited to, silane coupling agents, silylation agents, silane coupling agents having a fluorinated alkyl group, organic titanate coupling agents, aluminum coupling agents, silicone oils, and modified silicone oils. Preferably, silica and titanium oxide used as the external additive is surface-treated with such a fluidity improving agent to become hydrophobized silica and hydrophobized titanium oxide, respectively.

Cleanability Improving Agent

The cleanability improving agent is an additive that facilitates easy removal of the toner remaining on a photoconductor or primary transfer medium after image transfer. Specific examples of the cleanability improving agent include, but are not limited to, metal salts of fatty acids (e.g., zinc stearate and calcium stearate) and fine particles of polymers prepared by soap-free emulsion polymerization (e.g., polymethyl methacrylate and polystyrene). Preferably, the particle size distribution of the fine particles of polymers is as narrow as possible. More preferably, the volume average particle diameter thereof is in the range of from 0.01 to 1 μm.

Magnetic Material

Specific examples of usable magnetic materials include, but are not limited to, iron powder, magnetite, and ferrite. In particular, those having white color are preferable.

Toner Properties

Glass Transition Temperature (Tg1st)

Preferably, a glass transition temperature ("Tg1 st") of the toner that is measured in the first heating of differential scanning calorimetry (DSC) is in the range of from 20° C. to 50° C.

Conventional toners which have a Tg of 50° C. or less easily cause aggregation when transported in summer season or in tropical regions or stored under a temperature-variable environment. As a result, such a conventional toner may be solidified in a toner bottle or fixedly adhered to a developing device. In these cases, toner clogging occurs within the toner bottle and defective toner supply is caused, or abnormal image is generated due to the occurrence of toner adhesion to the developing device.

Preferably, the toner in accordance with some embodiments of the present invention has a glass transition temperature lower than that of conventional toners. As the amorphous polyester resin A, serving as a low Tg component in the toner, is non-linear, the toner can maintain heat-resistant storage stability. Especially when the amorphous polyester resin A has urethane bond or urea bond each having a high cohesive force, the toner can maintain heat-resistant storage stability in a more effective manner.

Glass Transition Temperature (Tg2nd)

Preferably, a glass transition temperature ("Tg2nd") of the toner that is measured in the second heating of differential scanning calorimetry (DSC) is in the range of from −5° C. to 45° C., more preferably from −5° C. to 30° C.

Preferably, the difference between Tg1st and Tg2nd (i.e., Tg1st−Tg2nd) is 10° C. or more, but is not limited thereto. Preferably, the upper limit of the difference is 50° C. or less.

When the difference is 10° C. or more, low-temperature fixability is excellent. When the difference is 10° C. or more, the crystalline polyester resin C and the amorphous polyester resins A and B, which have been incompatible with each other before the first heating, get to compatiblize with each other after the first heating. In this case, the crystalline polyester resin C and the amorphous polyester resins A and B need not necessarily in a complete compatibilized state.

Melting Point

Preferably, the melting point of the toner is in the range of from 60° C. to 80° C., but is not limited thereto.

Particle Diameter

Preferably, the volume average particle diameter of the toner is in the range of from 3 to 7 μm, but is not limited thereto. In addition, preferably, the ratio of the volume average particle diameter to the number average particle diameter is 1.2 or less. Furthermore, preferably, the toner includes toner particles having a volume-based particle diameter of 2 μm or less in an amount of from 1% to 10% by number.

Calculation and Analysis Methods for Various Properties of Toner and Toner Constituents Various properties of the polyester resins (e.g., the non-linear amorphous polyester resin A, the amorphous polyester resin B, and the crystalline polyester resin C) and the release agent can be measured with the single body thereof. Alternatively, such toner constituents may be separated (isolated) from the toner by gel permeation chromatography (GPC), etc., and thereafter subjected to specific analysis (to be described later) to measure various properties (e.g., Tg, molecular weight, and melting point) and to determine mass ratio among toner constituents.

Each of the toner constituents can be separated from the toner by GPC in the following manner.

In a GPC measurement using THF (tetrahydrofuran) as a mobile phase, the eluate is divided into fractions by a fraction collector, and the fractions corresponding to the desired molecular weight portion in the total area of the elution curve are collected.

The collected fractions of the eluate are condensed and dried by an evaporator, etc. The resulting solid is dissolved in a deuterated solvent, such as deuterated chloroform or deuterated THF, and subjected to $^{1}$H-NMR measurement to determine integrated ratio of each element and calculate the constitutional monomer ratio in the eluted components.

Alternatively, the constitutional monomer ratio may be determined by hydrolyzing the condensed eluate with sodium hydroxide, etc., and subjecting the decomposition product to a qualitative quantitative analysis by high-performance liquid chromatography (HPLC).

In a case in which the toner is produced by a method including the process of forming the amorphous polyester resin A by causing an elongation reaction and/or a cross-linking reaction between the non-linear reactive precursor and the curing agent while forming mother toner particles, the amorphous polyester resin A may be separated from the toner by GPC, etc. to determine Tg, etc. from the separated amorphous polyester resin A. Alternatively, the amorphous polyester resin A may be previously synthesized by causing an elongation reaction and/or a cross-linking reaction between the non-linear reactive precursor and the curing agent, and the properties such as Tg may be determined from the synthesized amorphous polyester resin A.

Separation of Toner Constituents/Measurement of Molecular Weight and Distribution Thereof A measurement is performed using an instrument HLC-8020GPC (available from Tosoh Corporation) and 3-tandem columns TGKgel SuperHXM-H in the following manner.

The columns are stabilized in a heat chamber at 40° C. A solvent tetrahydrofuran (THF) is let to flow in the columns at 40° C. at a flow rate of 0.35 mL/min, and 10 μL of a THF solution of a sample (e.g., toner or resin), the sample concentration of which is adjusted to from 0.05% to 0.6% by mass, is injected therein.

The weight average molecular weight (Mw) of the sample is determined by comparing the molecular weight distribution of the sample with a calibration curve that is compiled with several types of monodisperse polystyrene standard samples, that shows the relation between the logarithmic values of molecular weights and the number of counts.

The standard polystyrene samples used to create the calibration curve include SHOWDEX STANDARD series available from Showa Denko K.K., each having a peak molecular weight (Mp) of 6,540,000, 3,570,000, 651,000, 251,000, 110,000, 45,000, 19,300, 6,700, 2,800, and 580, and toluene. As the detector, an RI (refractive index) detector is used.

The rate of constituents having a molecular weight of 600 or less is determined from an intersection of an integrated molecular weight distribution curve with a line indicating a molecular weight of 600.

A fraction collector, disposed at the eluate discharge port of the GPC instrument, collects a fraction of the eluate at every predetermined count. Every time the collected fractions correspond to 5% of the area of the elution curve, the collected fractions are separated.

Each separated eluate in an amount of 30 mg is dissolved in 1 mL of deuterated chloroform. As a standard substance, 0.05% by volume of tetramethylsilane (TMS) is further added thereto.

The resulting solution is poured in a glass tube having a diameter of 5 mm and subjected to an NMR measurement using a nuclear magnetic resonance spectrometer (JNM-AL400 available from JEOL Ltd.) to obtain a spectrum. The measurement is performed at a temperature of from 23° C. to 25° C., and the number of accumulation is 128.

The monomer composition and composition ratio of each toner constituent, such as the non-linear amorphous polyester resin A, the amorphous polyester resin B, and the crystalline polyester resin C, can be determined from the peak integral ratio of the spectrum.

Specifically, a monomer composition ratio can be determined by peak assignment.

For example, a peak at around 8.25 ppm is assigned to the benzene ring of trimellitic acid (corresponding to 1 hydrogen atom); a peak at around 8.07 to 8.10 ppm is assigned to the benzene ring of terephthalic acid (corresponding to 4 hydrogen atoms); a peak at around 7.1 to 7.25 ppm is assigned to the benzene ring of bisphenol A (corresponding to 4 hydrogen atoms); a peak at around 6.8 ppm is assigned to the benzene ring of bisphenol A (corresponding to 4 hydrogen atoms) and the double bond of fumaric acid (corresponding to 2 hydrogen atoms); a peak at around 5.2 to 5.4 ppm is assigned to the methine of propylene oxide adduct of bisphenol A (corresponding to 1 hydrogen atom); a peak at around 3.7 to 4.7 ppm is assigned to the methylene of propylene oxide adduct of bisphenol A (corresponding to 2 hydrogen atoms) and the methylene of ethylene oxide adduct of bisphenol A (corresponding to 4 hydrogen atoms); and a peak at around 1.6 ppm is assigned to the methyl group of bisphenol A (corresponding to 6 hydrogen atoms).

As a result of peak assignment, the collected fractions of the eluate in which the non-linear amorphous polyester resin A accounts for 90% or more can be treated as the non-linear amorphous polyester resin A. Similarly, the collected fractions of the eluate in which the amorphous polyester resin B accounts for 90% or more can be treated as the amorphous polyester resin B. Similarly, the collected fractions of the eluate in which the crystalline polyester resin C accounts for 90% or more can be treated as the crystalline polyester resin C.

Measurement of Content Rate of Fluorine Atom

X-ray Photoelectron Spectroscopy (XPS)

The content rate (atomic %) of fluorine atom at the surface of the toner can be determined by X-ray photoelectron spectroscopy (XPS) using the below-described measuring instrument under the below-described conditions.

An aluminum pan is filled with a sample and fixed to a sample holder with a carbon sheet. A surface atom concentration is calculated using relative sensitivity coefficients provided by Kratos Analytical Ltd.

Measuring instrument: AXIS-ULTRA available from Kratos Analytical Ltd.

Measuring light source: AI (monochrome meter)

Measuring power: 105 W (15 kV, 7 mA)

Analysis area: 900 μm×600 μm

Measuring mode: Hybrid mode

Pass energy: 160 eV (wide scan), 40 eV (narrow scan)

Energy step: 1.0 eV (wide scan), 0.2 eV (narrow scan)

Relative sensitivity coefficients: provided by Kratos Analytical Ltd.

X-ray Fluorescence Analysis (XRF)

The content rate (weight %) of fluorine atom in the toner can be determined by X-ray fluorescence analysis (XRF) using the below-described measuring instrument under the below-described conditions.

First, 3.00 g of a sample is pelletized into a pellet having a diameter of 3 mm and a thickness of 2 mm.

The pellet is subjected to a quantitative analysis by an X-ray fluorescence analyzer to measure the content of fluorine atom. In the measurement, a fluorine standardized sample (available from Rigaku Corporation) is used to calculate the content with correction.

Measuring instrument: ZSX-100e available from Rigaku Corporation X-ray bulb:

Rh X-ray tube voltage: 40 kV X-ray tube current: 20 mA

Measurement of Melting Point and Glass Transition Temperature (Tg)

Melting point and glass transition temperature (Tg) can be measured with a DSC (differential scanning calorimeter) system (Q-200 available from TA Instruments) as follows.

First, about 5.0 mg of a sample is put in an aluminum sample container. The sample container is put on a holder unit and set in an electric furnace. The sample container is heated from −80° C. to 150° C. at a temperature rising rate of 10° C./min ("first heating") in nitrogen atmosphere. The sample container is thereafter cooled from 150° C. to −80° C. at a temperature falling rate of 10° C./min and heated to 150° C. again at a temperature rising rate of 10° C./min ("second heating"). In each of the first heating and the second heating, a DSC curve is obtained by the differential scanning calorimeter (Q-200 available from TA Instruments).

The obtained DSC curves are analyzed with an analysis program installed in Q-200. By selecting the DSC curve obtained in the first heating, a glass transition temperature in the first heating can be determined. Similarly, by selecting the DSC curve obtained in the second heating, a glass transition temperature in the second heating can be determined.

In addition, by selecting the DSC curve obtained in the first heating, an endothermic peak temperature in the first heating can be determined as a melting point in the first heating. Similarly, by selecting the DSC curve obtained in the second heating, an endothermic peak temperature in the second heating can be determined as a melting point in the second heating.

In the present disclosure, Tg1st and Tg2nd denote glass transition temperatures measured in the first heating and the second heating, respectively, when the sample is a toner.

In the present disclosure, glass transition temperatures and melting points of the toner constituents, such as the non-linear amorphous polyester resin A, the amorphous polyester resin B, the crystalline polyester resin C, and the release agent, are those measured in the second heating, unless otherwise specified.

Measurement of Molecular Weight

Molecular weights of each constituents in a toner or resin can be measured under the following conditions.

Gel permeation chromatography (GPC) instrument: HLC-8220 GPC (available from Tohsoh Corporation)

Columns: TSKgel SuperHZM-H 15 cm, 3-tandem (available from Tosoh Corporation)

Temperature: 40° C.

Solvent: THF

Flow rate: 0.35 mL/min

Sample concentration: 0.15%, Injection amount: 0.4 mL

Pretreatment of Sample: A sample (toner or resin) is dissolved in tetrahydrofuran (THF, containing a stabilizer, from Wako Pure Chemical Industries, Ltd.) to prepare a 0.15% by mass THF solution of the sample. The solution is filtered with a 0.2-μm filter, and 100 μL of the filtrate is injected.

The molecular weight of the sample is determined by comparing the molecular weight distribution of the sample with a calibration curve, compiled with several types of monodisperse polystyrene standard samples, that shows the relation between the logarithmic values of molecular weights and the number of counts. The standard polystyrene samples used to create the calibration curve include SHOWDEX STANDARD Std. No. S-7300, S-210, S-390, S-875, S-1980, S-10.9, S-629, S-3.0, and S-0.580 available from Showa Denko K.K. As the detector, a refractive index (RI) detector is used.

Toner Production Method

The toner in accordance with some embodiments of the present invention may be produced by any method. Preferably, the toner is produced by a method including the processes of: preparing an oil phase by dissolving or dispersing toner constituents in an organic solvent, where the toner constituents include at least binder resins (including amorphous polyester resin and crystalline polyester resin) and a fluorine-modified layered inorganic mineral; and dispersing the oil phase in an aqueous medium.

More specifically, the toner is preferably granulated by dispersing an oil phase containing the non-linear amorphous polyester resin A, the amorphous polyester resin B, the crystalline polyester resin C, and the fluorine-modified layered inorganic mineral, and optionally the release agent, the colorant, etc., in the aqueous medium.

As an example, the toner may be produced by a dissolution suspension method.

One example method is described below that forms toner particles while producing the non-linear amorphous polyester resin A by causing an elongation reaction and/or a cross-linking reaction between the non-linear reactive precursor and the curing agent. This method involves the processes of preparation of an aqueous medium, preparation of an oil phase containing toner constituents, emulsification or dispersion of the toner constituents, removal of an organic solvent, and washing of toner particles.

After being washed, dried, and classified, the toner particles may be mixed with an external additive.

Preparation of Aqueous Medium (Aqueous Phase)

In the aqueous medium, resin particles are dispersed. Preferably, the added amount of the resin particles in the aqueous medium is in the range of from 0.5 to 10 parts by mass based on 100 parts of the aqueous medium.

Specific examples of the aqueous medium include, but are not limited to, water, water-miscible solvents, and mixtures thereof. Each of these media can be used alone or in combination with others. Among these, water is preferable.

Specific examples of the water-miscible solvents include, but are not limited to, alcohols, dimethylformamide, tetrahydrofuran, cellosolves, and lower ketones. Specific examples of the alcohols include, but are not limited to, methanol, isopropanol, and ethylene glycol. Specific examples of the lower ketones include, but are not limited to, acetone and methyl ethyl ketone.

Preparation of Oil Phase

The oil phase may be prepared by dissolving or dispersing toner constituents in an organic solvent, where the toner constituents include at least the non-linear reactive precursor, the amorphous polyester resin B, the crystalline polyester resin C, and the fluorine-modified layered inorganic mineral, and optionally the curing agent, the release agent, and/or the colorant.

Preferably, the organic solvent used for the oil phase is an organic solvent having a boiling point less than 150° C., that is easy to remove, but is not limited thereto.

Emulsification or Dispersion

The oil phase containing the toner constituents is emulsified or dispersed in the aqueous medium. At the time when the oil phase is emulsified or dispersed, the non-linear amorphous polyester resin A is formed by causing an elongation reaction and/or a cross-linking reaction between the curing agent and the non-linear reactive precursor.

The non-linear amorphous polyester resin A may be formed by one of the following procedures (1) to (3).

(1) Emulsify or disperse an oil phase containing the non-linear reactive precursor and the curing agent in an aqueous medium, to cause an elongation reaction and/or a cross-linking reaction between the curing agent and the non-linear reactive precursor in the aqueous medium, thereby forming the non-linear amorphous polyester resin A.

(2) Emulsify or disperse an oil phase containing the non-linear reactive precursor in an aqueous medium to which the curing agent has been previously added, to cause an elongation reaction and/or a cross-linking reaction between the curing agent and the non-linear reactive precursor in the aqueous medium, thereby forming the non-linear amorphous polyester resin A.

(3) Emulsify or disperse an oil phase containing the non-linear reactive precursor in an aqueous medium and thereafter add the curing agent to the aqueous medium, to cause an elongation reaction and/or a cross-linking reaction between the curing agent and the non-linear reactive precursor in the aqueous medium from the interfaces of dispersed particles, thereby forming the non-linear amorphous polyester resin A.

In a case in which an elongation reaction and/or a cross-linking reaction between the curing agent and the non-linear reactive precursor is caused from the interfaces of dispersed particles, the non-linear amorphous polyester resin A is preferentially formed at the surface of the resulting toner while forming a concentration gradient of the non-linear amorphous polyester resin A within the toner.

The reaction conditions (e.g., reaction time, reaction temperature) for forming the non-linear amorphous polyester resin A are not limited and determined depending on the combination of the curing agent and the non-linear reactive precursor.

Preferably, the reaction time is in the range of from 10 minutes to 40 hours, more preferably from 2 to 24 hours, but is not limited thereto.

Preferably, the reaction temperature is in the range of from 0° C. to 150° C., more preferably from 40° C. to 98° C., but is not limited thereto.

The non-linear reactive precursor may be stably dispersed in the aqueous medium by, for example, adding an oil phase, in which the toner constituents are dissolved or dispersed in an organic solvent, to the aqueous medium and thereafter applying a shearing force thereto.

Examples of dispersers for dispersing the oil phase include, but are not limited to, low-speed shearing type dispersers, high-speed shearing type dispersers, friction type dispersers, high-pressure jet type dispersers, and ultrasonic dispersers.

Among these dispersers, high-speed shearing type dispersers are preferable because they can adjust the particle diameter of the dispersoids (oil droplets) to 2 to 20 μm.

When a high-speed shearing type disperser is used, dispersing conditions, such as the number of revolution, dispersing time, and dispersing temperature, are determined depending on the purpose.

Preferably, the number of revolution is in the range of from 1,000 to 30,000 rpm, more preferably from 5,000 rpm to 20,000 rpm, but is not limited thereto.

Preferably, the reaction time is in the range of from 0.1 to 5 minutes in the case of batch-type disperser, but is not limited thereto.

Preferably, the dispersing temperature is in the range of from 0° C. to 150° C., more preferably from 40° C. to 98° C., under pressure, but is not limited thereto. Generally, as the dispersing temperature becomes higher, the dispersing becomes easier.

Preferably, the amount of the aqueous medium used when the toner constituents are emulsified or dispersed therein is in the range of from 50 to 2,000 parts by mass, more preferably from 100 to 1,000 parts by mass, based on 100 parts by mass of the toner constituents.

When the used amount of the aqueous medium is 50 parts by mass or less, the dispersion state of the toner constituents may degrade and mother toner particles having a desired particle size cannot be obtained. When the used amount of the aqueous medium is in excess of 2,000 parts by mass, manufacturing cost may be increased.

Preferably, when the oil phase containing the toner constituents is emulsified or dispersed in the aqueous medium, a dispersant is used to stabilize dispersoids (oil droplets) to obtain toner particles with a desired shape and a narrow particle size distribution.

Specific examples of the dispersant include, but are not limited to, surfactants, poorly-water-soluble inorganic compounds, and polymeric protection colloids. Each of these dispersants can be used alone or in combination with others. Among these, surfactants are preferable.

In the elongation reaction and/or cross-linking reaction for forming the non-linear amorphous polyester resin A, a catalyst may be used.

Specific examples of the catalyst include, but are not limited to, dibutyltin laurate and dioctyltin laurate.

Removal of Organic Solvent

The organic solvent may be removed from the dispersion liquid (emulsion slurry) by, for example, gradually raising the temperature of the reaction system to completely evaporate the organic solvent from oil droplets, or spraying the dispersion liquid into dry atmosphere to completely evaporate the organic solvent from oil droplets.

As the organic solvent has been removed, mother toner particles are isolated. The mother toner particles are washed and dried, and optionally classified by size. The classification may be performed by removing ultrafine particles by cyclone separation, decantation, or centrifugal separation. Alternatively, the classification may be performed after the mother toner particles have been dried.

Washing

The mother toner particles may be washed with an alkaline compound. Preferably, the mother toner particles may be washed with an alkali first, then with an acid, and finally with water.

By washing the mother toner particles with an alkali, emulsifiers, dispersants, and ionic impurities remaining on the surfaces of the mother toner particles can be removed.

The above toner comprising the amorphous polyester resin A is produced using organic resin particles as a dispersion (emulsion) stabilizer for the purpose of narrowing the particle size distribution of the toner particles. When the organic resin particles excessively remain at the surface of toner particles, fixing property may be degraded and charging property may be adversely affected. Therefore, it is preferable to remove the organic resin particles from the surface of the toner particles.

Since the organic resin particles contain an acidic component, they can be easily removed when being swelled or dissolved by being washed with an alkali.

The amorphous polyester resin A is formed using the amine. The unreacted amine may form an associated body with an acidic group (carboxyl group) in the amorphous polyester resin A, thereby suppressing an elongation reaction after the emulsification. Furthermore, the acidity of the amorphous polyester resin A is degraded, resulting in deterioration of charge property and adhesion property to paper.

As the toner particles are washed with an alkali, hydrogen atom on a terminal carboxyl group in the amorphous polyester resin A is substituted with sodium atom. As the toner particles are thereafter washed with an acid, the terminal carboxyl group in the amorphous polyester resin A recovers to proceed the elongation reaction again.

Mixing

The mother toner particles may be further mixed with particles of the external additive. By applying a mechanical impact in the mixing, the external additive particles are suppressed from releasing from the surface of the mother toner particles.

A mechanical impulsive force can be applied using blades rotating at a high speed, or by accelerating the mother toner particles in a high-speed airflow to allow the toner particles collide with each other or a collision plate.

A mechanical impulsive force can be applied using, for example, ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Developer The developer in accordance with some embodiments of the present invention comprises at least the above-described toner and optionally other components such as a carrier.

The developer has excellent transferability and chargeability, and can reliably form high quality image.

The developer may be either a one-component developer or a two-component developer. When the developer is used for a high-speed printer that is compatible with recent improvement in information processing speed, it is preferable that the developer is a two-component developer for extending the lifespan.

In the case of one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

Carrier

The carrier may comprise a core material and a resin layer that covers the core material.

The developer can be used for image forming methods employing electrophotographic methods such as magnetic one-component developing method, non-magnetic one-component developing method, and two-component developing method.

Developer Container

A developer container for containing the developer in accordance with some embodiments of the present invention has no particular limitation. The developer container may include a container body and a cap.

The container body is not limited in size, shape, structure, and material. Preferably, the container body has a cylindrical shape. Preferably, on the inner circumferential surface of the container body, projections and recesses are formed in a spiral manner, so that the developer can move to the discharge port side as the container body rotates. More preferably, part or all of the projections and recesses formed in a spiral manner have an accordion function. The container body is preferably made of a resin material having good dimension accuracy, such as polyester resin, polyethylene resin, polypropylene resin, polystyrene resin, polyvinyl chloride resin, polyacrylic acid, polycarbonate resin, ABS resin, and polyacetal resin.

The developer container is easy to preserve, transport, and handle. Therefore, the developer container is detachably mountable on a process cartridge or an image forming apparatus (to be described later) to supply the developer thereto.

Toner Storage Unit

In the present disclosure, a toner storage unit refers to a unit that has a function of storing toner and that is storing the above toner. The toner storage unit may be in the form of, for example, a toner storage container, a developing device, or a process cartridge.

In the present disclosure, the toner storage container refers to a container storing the toner.

The developing device refers to a device storing the toner and having a developing unit configured to develop an electrostatic latent image into a toner image with the toner.

The process cartridge refers to a combined body of an electrostatic latent image bearer (simply "image bearer") with a developing unit storing the toner, detachably mountable on an image forming apparatus. The process cartridge may further include at least one of a charger, an irradiator, and a cleaner.

An image forming apparatus to which the toner storage unit is attached can perform image forming operation utilizing the above toner having excellent low-temperature fixability, heat-resistant storage stability, and charge stability.

Image Forming Apparatus and Image Forming Method

An image forming apparatus in accordance with some embodiments of the present invention includes at least an electrostatic latent image bearer (also referred to as "photoconductor"), an electrostatic latent image forming device, and a developing device, and optionally other members.

An image forming method in accordance with some embodiments of the present invention includes at least an electrostatic latent image forming process and a developing process, and optionally other processes.

The image forming method is preferably performed by the image forming apparatus. The electrostatic latent image forming process is preferably performed by the electrostatic latent image forming device. The developing process is preferably performed by the developing device. Other optional processes are preferably performed by other optional members.

Electrostatic Latent Image Bearer

The electrostatic latent image bearing member is not limited in material, structure, and size. Specific examples of usable materials include, but are not limited to, inorganic photoconductors such as amorphous silicon and selenium, and organic photoconductors such as polysilane and phthalopolymethine. Among these materials, amorphous silicon is preferable for long operating life.

Electrostatic Latent Image Forming Device and Electrostatic Latent Image Forming Process The electrostatic latent image forming device has no limit so long as it can form an electrostatic latent image on the electrostatic latent image bearer. For example, the electrostatic latent image forming device may include a charger to uniformly charge a surface of the electrostatic latent image bearer and an irradiator to irradiate the surface of the electrostatic latent image bearer with light containing image information.

The electrostatic latent image forming process has no limit so long as an electrostatic latent image can be formed on the electrostatic latent image bearer. For example, the electrostatic latent image forming process may include charging a surface of the electrostatic latent image bearing member and irradiating the surface with light containing image information. The electrostatic latent image forming process can be performed by the electrostatic latent image forming device.

Charger and Charging Process

Specific examples of the charger include, but are not limited to, contact chargers equipped with a conductive or semiconductive roller, brush, film, or rubber blade, and non-contact chargers employing corona discharge such as corotron and scorotron.

The charging process may include applying a voltage to a surface of the electrostatic latent image bearer by the charger.

Irradiator and Irradiating Process

The irradiator has no limit so long as it can emit light containing image information to the surface of the electrostatic latent image bearer charged by the charger. Specific examples of the irradiator include, but are not limited to, various irradiators of radiation optical system type, rod lens array type, laser optical type, and liquid crystal shutter optical type.

The irradiating process may include irradiating the surface of the electrostatic latent image bearer with light containing image information emitted from the irradiator.

The irradiation of light may be performed from the back surface side of the electrostatic latent image bearing member.

Developing Device and Developing Process

The developing device has no limit so long as it can store a toner and develop the electrostatic latent image formed on the electrostatic latent image bearer into a visible image with the toner.

The developing process has no limit so long as the electrostatic latent image formed on the electrostatic latent image bearer can be developed into a visible image with a toner. The developing process is preferably performed by the developing device.

The developing device may employ either a dry developing method or a wet developing method. The developing device may be either a single-color developing device or a multi-color developing device.

Preferably, the developing device includes a stirrer to frictionally stir and charge the toner, a magnetic field generator fixed inside the developing device, and a rotatable developer bearer to bear on its surface a developer containing the toner.

Other Devices and Other Processes

Examples of the other optional devices include, but are not limited to, a transfer device, a fixing device, a cleaner, a neutralizer, a recycler, and a controller.

Examples of the other optional processes include, but are not limited to, a transfer process, a fixing process, a cleaning process, a neutralization process, a recycle process, and a control process.

An image forming apparatus in accordance with some embodiments of the present invention is described below with reference to FIG. 1. An image forming apparatus 100A illustrated in FIG. 1 includes a photoconductor drum 10 serving as the electrostatic latent image bearer, a charging roller 20 serving as the charger, an irradiator 30, developing devices 45K, 45Y, 45M and 45C (collectively "developing devices 45"), an intermediate transfer medium 50, a cleaner 6 having a cleaning blade, and a neutralization lamp 70 serving as the neutralizer.

The intermediate transfer medium 50 is in the form of an endless belt and is stretched taut by three rollers 51 disposed inside the loop of the endless belt. The intermediate transfer medium 50 is movable in the direction indicated by arrow in FIG. 1. One or two of the three rollers 51 also function(s) as transfer bias roller(s) for applying a predetermined transfer bias (primary transfer bias) to the intermediate transfer medium 50.

In the vicinity of the intermediate transfer medium 50, a cleaner 90 equipped with a cleaning blade is disposed. A transfer roller 80 capable of applying a transfer bias to a recoding sheet 95, for secondarily transferring a toner image thereon, is disposed facing the intermediate transfer medium 50.

Around the intermediate transfer medium 50, a corona charger 52 that gives charge to the toner image on the intermediate transfer medium 50 is disposed between a contact portion of the intermediate transfer medium 50 with the photoconductor drum 10 and another contact portion of the intermediate transfer medium 50 with the recoding sheet 95.

The developing devices 45K, 45Y, 45M, and 45C, for respectively developing black, yellow, magenta, and cyan images, include respective developer containers 42K, 42Y, 42M, and 42C, respective developer supply rollers 43K, 43Y, 43M, and 43C, and respective developing rollers 44K, 44Y, 44M, and 44C.

In the image forming apparatus 100A, first, the charging roller 20 uniformly charges the photoconductor drum 10, and the irradiator 30 emits light L containing image information to the photoconductor drum 10, so that an electrostatic latent image is formed. Next, each of the developing devices 45 supplies the developer to the electrostatic latent image formed on the photoconductor drum 10 to form a toner image. The toner image is primarily transferred onto the intermediate transfer medium 50 by a transfer bias applied from the rollers 51. After the corona charger 52 has given charge to the toner image on the intermediate transfer medium 50, the toner image is secondarily transferred onto the recoding sheet 95. Residual toner particles remaining on the photoconductor drum 10 are removed by the cleaner 6. The photoconductor drum 10 is neutralized by the neutralization lamp 70.

Figure 2:
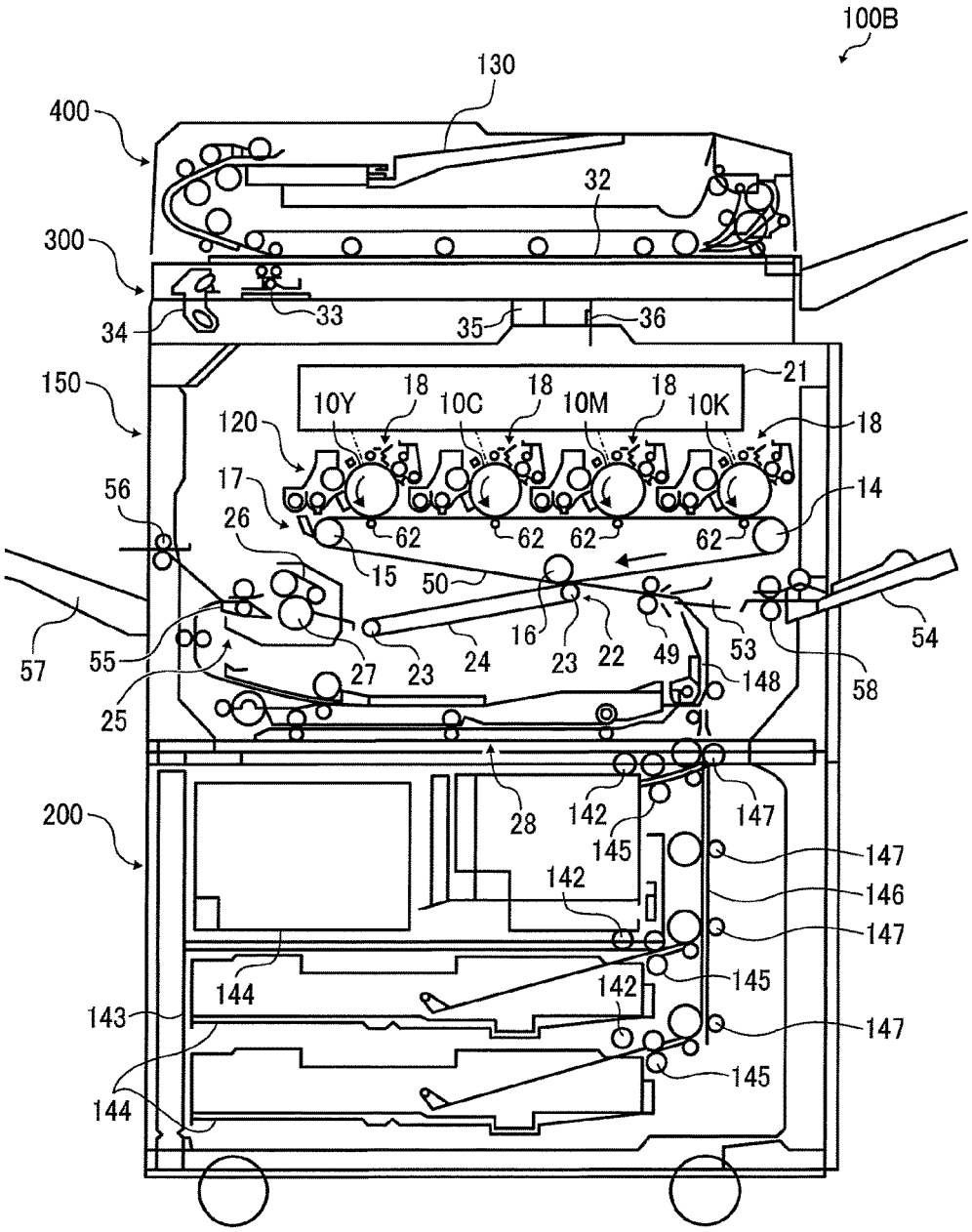
FIG. 2 is a schematic view of an image forming apparatus in accordance with some embodiments of the present invention.

FIG. 2 is a schematic view of another image forming apparatus in accordance with some embodiments of the present invention. An image forming apparatus 100B, which is a tandem-type full-color image forming apparatus, includes a copier main body 150, a sheet feed table 200, a scanner 300, and an automatic document feeder (ADF) 400.

In the central part of the copier main body 150, an intermediate transfer medium 50 in the form of an endless belt is disposed. The intermediate transfer medium 50 is stretched taut by support rollers 14, 15, and 16 and rotatable in the direction indicated by arrow in FIG. 2.

In the vicinity of the support roller 15, a cleaner 17 for removing residual toner particles remaining on the intermediate transfer medium 50 is disposed. Four image forming units 18 for respectively forming yellow, cyan, magenta, and black images are arranged in tandem facing a part of the intermediate transfer medium 50 stretched between the support rollers 14 and 15 in the direction of conveyance of the intermediate transfer medium 50, thus forming a tandem developing device 120.

Figure 3:
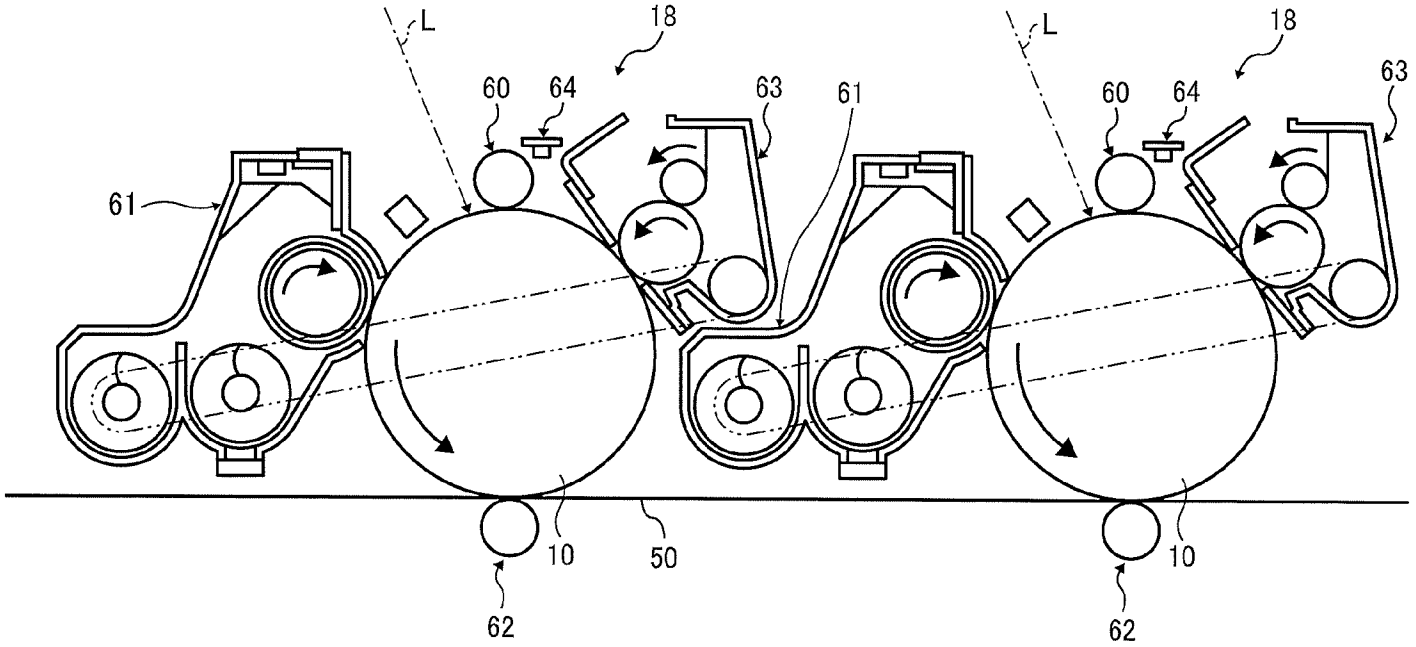
FIG. 3 is a schematic view of image forming units included in the image forming apparatus illustrated in FIG. 2.

Referring to FIG. 3, each image forming unit 18 includes a photoconductor drum 10, a charging roller 60 to uniformly charge the photoconductor drum 10, a developing device 61 to develop an electrostatic latent image formed on the photoconductor drum 10 into a toner image with a developer of black, yellow, magenta, or cyan color, a transfer roller 62 to transfer the toner image onto the intermediate transfer medium 50, a cleaner 63, and a neutralization lamp 64. In FIG. 3, a symbol L denotes a laser light beam.

Referring back to FIG. 2, in the vicinity of the tandem developing device 120, an irradiator 21 is disposed. The irradiator 21 emits light to the photoconductor drum 10 to form an electrostatic latent image thereon.

A secondary transfer device 22 is disposed on the opposite side of the tandem developing device 120 relative to the intermediate transfer medium 50. The secondary transfer device 22 includes a secondary transfer belt 24 in the form of an endless belt stretched taut with a pair of rollers 23. A recording sheet conveyed on the secondary transfer belt 24 and the intermediate transfer medium 50 can contact with each other.

A fixing device 25 is disposed in the vicinity of the transfer device 22. The fixing device 25 includes a fixing belt 26 in the form of an endless belt and a pressing roller 27 pressed against the fixing belt 26.

In the vicinity of the transfer device 22 and the fixing device 25, a sheet reversing device 28 is disposed for reversing the recording sheet so that images can be formed on both surfaces of the recording sheet.

A full-color image forming (color copying) operation performed in the image forming apparatus 100B is described below. First, a document is set on a document table 130 of the automatic document feeder 400. Alternatively, a document is set on a contact glass 32 of the scanner 300 while the automatic document feeder 400 is lifted up, followed by holding down of the automatic document feeder 400. As a start switch is pressed, the scanner 300 starts driving after the document is moved onto the contact glass 32 in a case in which a document is set on the contact glass 32, or the scanner 300 immediately starts driving in a case in which a document is set on the automatic document feeder 400, so that a first traveling body 33 and a second traveling body 34 start traveling. The first traveling body 33 directs light emitted from a light source to the document. A mirror carried by the second traveling body 34 reflects light reflected from the document toward a reading sensor 36 through an imaging lens 35. Thus, the document is read and converted into image information of black, magenta, cyan, and yellow.

The irradiator 21 forms an electrostatic latent image of each color on each photoconductor drum 10Y, 10C, 10M, or 10K based on image information of each color. Each electrostatic latent image is developed into a toner image with the developer of each color supplied from each image forming unit 18. The toner images are primarily transferred onto the intermediate transfer medium 50 that is rotated by the support rollers 14, 15, and 16 in a successive and overlapping manner. Thus, a composite toner image is formed on the intermediate transfer medium 50.

At the same time, in the sheet feed table 200, one of sheet feed rollers 142 starts rotating to feed recording sheets from one of sheet feed cassettes 144 in a sheet bank 143. One of separation rollers 145 separates the recording sheets one by one and feeds them to a sheet feed path 146. Feed rollers 147 feed each sheet to a sheet feed path 148 in the copier main body 150. The sheet is stopped by striking a registration roller 49. Alternatively, recording sheets may be fed from a manual feed tray 54. In this case, a separation roller 58 separates the recording sheets one by one and feeds them to a manual sheet feed path 53. The sheet is stopped by striking the registration roller 49. The registration roller 49 is generally grounded. Alternatively, the registration roller 49 may be applied with a bias for the purpose of removing paper powders from the sheet.

The registration roller 49 starts rotating in synchronization with an entry of the composite toner image formed on the intermediate transfer medium 50 to between the intermediate transfer medium 50 and the transfer device 22, so that the recording sheet is fed thereto and the composite toner image can be secondarily transferred onto the recording sheet.

The recording sheet having the composite toner image thereon is fed from the transfer device 22 to the fixing device 25. In the fixing device 25, the composite toner image is heated and pressurized by the fixing belt 26 and the pressing roller 27 and thereby fixed on the recording sheet. A switch claw 55 switches sheet feed paths so that the recording sheet is ejected by an ejection roller 56 and stacked on a sheet ejection tray 57. Alternatively, the switch claw 55 may switch sheet feed paths so that the sheet is introduced into the sheet reversing device 28 and gets reversed. The sheet is then introduced to the transfer position again so that another image is recorded on the back side of the sheet. Thereafter, the sheet is ejected by the ejection roller 56 and stacked on the sheet ejection tray 57.

Residual toner particles remaining on the intermediate transfer medium 50 after the composite image has been transferred are removed by the cleaner 17.

Process Cartridge

A process cartridge in accordance with some embodiments of the present invention includes an electrostatic latent image bearer to bear an electrostatic latent image and a developing device to develop the electrostatic latent image into a toner image with the developer in accordance with some embodiments of the present invention. The process cartridge is configured to be detachably mountable on an image forming apparatus. The process cartridge may further include other members, if necessary.

The developing device includes a developer container containing the developer in accordance with some embodiments of the present invention, and a developer bearer to bear and convey the developer contained in the developer container. The developing device may further include a regulator to regulate the thickness of the developer layer borne on the developer bearer.

Figure 4:
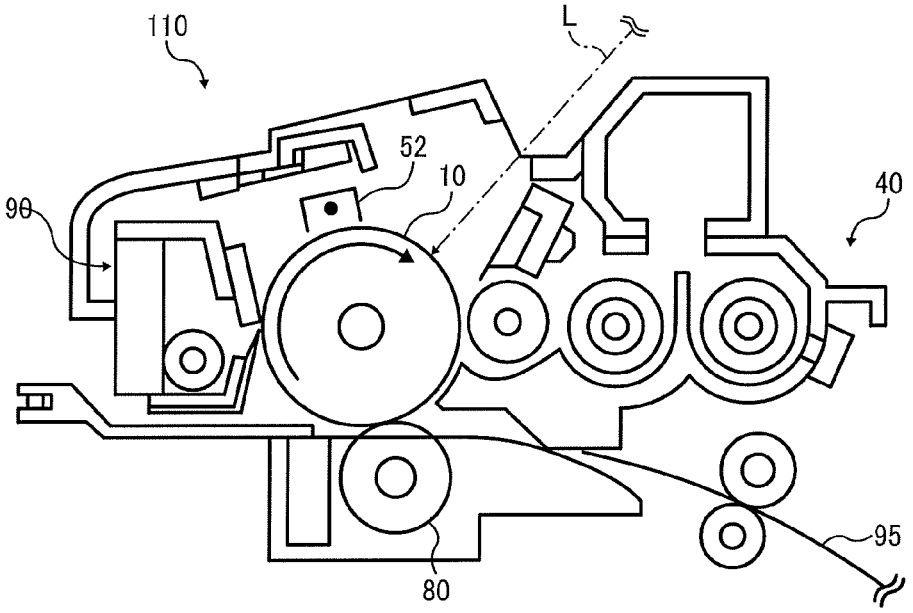
FIG. 4 is a schematic view of a process cartridge in accordance with some embodiments of the present invention.

FIG. 4 is a schematic view of a process cartridge in accordance with some embodiments of the present invention. A process cartridge 110 includes a photoconductor drum 10, a corona charger 52, a developing device 40, a transfer roller 80, and a cleaner 90. In FIG. 4, a numeral 95 denotes a recording sheet.

EXAMPLES

The present invention is described in detail with reference to the Examples but is not limited to the following Examples. "Parts" represents parts by mass and "% (percent)" represents percent by mass unless otherwise specified in the following description.

Preparation of Layered Inorganic Mineral A

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 4 parts of a silane coupling agent (trifluoropropyl trimethoxysilane) was further added thereto and stirred for 10 minutes. The slurry was filtered, dried in an oven at 150° C. for 90 minutes, and pulverized with a ball mill. Thus, a layered inorganic mineral A was obtained.

Preparation of Layered Inorganic Mineral B

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 40 parts of a silane coupling agent (trifluoropropyl trimethoxysilane) was further added thereto and stirred for 10 minutes. The slurry was filtered, dried in an oven at 150° C. for 90 minutes, and pulverized with a ball mill. Thus, a layered inorganic mineral B was obtained.

Preparation of Layered Inorganic Mineral C

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 4 parts of a silane coupling agent (2,2,2-trifluoroethyl trimethoxysilane) was further added thereto and stirred for 10 minutes. The slurry was filtered, dried in an oven at 150° C. for 90 minutes, and pulverized with a ball mill. Thus, a layered inorganic mineral C was obtained.

Preparation of Layered Inorganic Mineral D

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 40 parts of a silane coupling agent (2,2,2-trifluoroethyl trimethoxysilane) was further added thereto and stirred for 10 minutes. The slurry was filtered, dried in an oven at 150° C. for 90 minutes, and pulverized with a ball mill. Thus, a layered inorganic mineral D was obtained.

Preparation of Layered Inorganic Mineral E

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 48 parts of a silane coupling agent (trifluoropropyl trimethoxysilane) was further added thereto and stirred for 10 minutes. The slurry was filtered, dried in an oven at 150° C. for 90 minutes, and pulverized with a ball mill. Thus, a layered inorganic mineral E was obtained.

Preparation of Layered Inorganic Mineral F

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 2 parts of a silane coupling agent (trifluoropropyl trimethoxysilane) was further added thereto and stirred for 10 minutes. The slurry was filtered, dried in an oven at 150° C. for 90 minutes, and pulverized with a ball mill. Thus, a layered inorganic mineral F was obtained.

Preparation of Layered Inorganic Mineral G

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 3 parts of a silane coupling agent (trifluoropropyl trimethoxysilane) was further added thereto and stirred for 10 minutes. The slurry was filtered, dried in an oven at 150° C. for 90 minutes, and pulverized with a ball mill. Thus, a layered inorganic mineral G was obtained.

Preparation of Layered Inorganic Mineral H

First, 100 parts of a modified layered inorganic mineral montmorillonite (CLAYTONE® APA available from BYK Additives & Instruments), a part of which was modified with a quaternary ammonium salt having benzyl group, was added to 1,200 parts of water and stirred for 15 minutes to be dispersed therein. Thus, a slurry of the layered inorganic mineral was obtained. Next, 56 parts of a silane coupling agent (trifluoropropyl trimethoxysilane) was further added thereto and stirred for 10 minutes. The slurry was filtered, dried in an oven at 150° C. for 90 minutes, and pulverized with a ball mill. Thus, a layered inorganic mineral H was obtained.

Preparation Example 1

Synthesis of Ketimine

In a reaction vessel equipped with a stirrer and a thermometer, 170 parts of isophoronediamine and 75 parts of methyl ethyl ketone were contained and reacted at 50° C. for 5 hours. Thus, a ketimine 1 was prepared. The ketimine compound 1 had an amine value of 418.

Preparation Example A1

Synthesis of Non-linear Amorphous Polyester Resin A1

Synthesis of Prepolymer A1

A reaction vessel equipped with a cooling tube, a stirrer, and a nitrogen introducing tube was charged with diol components comprising 100% by mol of 3-methyl-1,5-pentanediol, dicarboxylic acid components comprising 50% by mol of terephthalic acid and 50% by mol of adipic acid, and 1% by mol (based on all monomers) of trimethylolpropane, along with 1,000 ppm (based on the resin components) of titanium tetraisopropoxide, such that the molar ratio (OH/COOH) of hydroxyl groups to carboxyl groups became 1.5. The vessel contents were heated to 200° C. over a period of about 4 hours, thereafter heated to 230° C. over a period of 2 hours, and the reaction was continued until outflow water was no more produced. The vessel contents were further reacted under reduced pressures of from 10 to 15 mmHg for 5 hours. Thus, an intermediate polyester A1 was prepared.

Next, in a reaction vessel equipped with a cooling tube, a stirrer, and a nitrogen introducing tube, the intermediate polyester A1 and isophorone diisocyanate (IPDI) were contained such that the molar ratio of isocyanate groups in IPDI to hydroxyl groups in the intermediate polyester became 2.0. The vessel contents were diluted with ethyl acetate to become a 50% ethyl acetate solution and further reacted at 100° C. for 5 hours. Thus, a prepolymer A1 was prepared.

Synthesis of Amorphous Polyester Resin A1

The above-prepared prepolymer A1 was stirred in a reaction vessel equipped with a heater, a stirrer, and a nitrogen introducing tube. Furthermore, the ketimine compound 1 was dropped in the reaction vessel, such that the amount of amine in the ketimine compound 1 became equimolar with the amount of isocyanate in the prepolymer A1, and stirred at 45° C. for 10 hours. Thus, a prepolymer elongated product was obtained. The prepolymer elongated product was dried at 50° C. under reduced pressures until the residual amount of ethyl acetate became 100 ppm or less. Thus, a non-linear amorphous polyester resin A1 was prepared.

Preparation Examples A2 to A5

Synthesis of Non-linear Amorphous Polyester Resins A2 to A5

Synthesis of Prepolymers A2 to A5

The procedure for preparing the prepolymer A1 was repeated except for changing the diol components and the dicarboxylic acid components as described in Table 1. Thus, prepolymers A2 to A5 were prepared.

In Table 1, each numeral in a parenthesis indicates a blending ratio (% by mol).

TABLE 1

| | Diols | Dicarboxylic Acids | OH/COOH |
|---|---|---|---|
| A1 | 3-Methyl-1,5-pentanediol (100) | Terephthalic acid/Adipic acid (50/50) | 1.5 |
| A2 | BisA-EO/BisA-PO (80/20) | Isophthalic acid/Adipic acid (85/15) | 1.5 |
| A3 | 3-Methyl-1,5-pentanediol (100) | Decanedioic acid (100) | 1.5 |
| A4 | BisA-EO/3-Methyl-1,5-pentanediol (80/20) | Isophthalic acid/Adipic acid (85/15) | 1.5 |
| A5 | 3-Methyl-1,5-pentanediol (100) | Isophthalic acid/Adipic acid (40/60) | 1.5 |

In Tables 1 and 2, "BisA-EO" and "BisA-PO" respectively represent ethylene oxide 2-mol adduct of bisphenol and propylene oxide 3-mol adduct of bisphenol A.

Synthesis of Amorphous Polyester Resin B1

In a four-neck flask equipped with a nitrogen introducing tube, a dewatering tube, a stirrer, and a thermocouple, alcohol components comprising ethylene oxide 2-mol adduct of bisphenol A (BisA-EO) and propylene oxide 3-mol adduct of bisphenol A (BisA-PO) at a molar ratio (BisA-EO/BisA-PO) of 60/40 and acid components comprising terephthalic acid and adipic acid at a molar ratio (terephthalic acid/adipic acid) of 85/15 were contained, such that the molar ratio (OH/COOH) of hydroxy groups to carboxyl groups became 1.3. After adding 500 ppm (based on the resin components) of titanium tetraisopropoxide to the flask, the flask contents were reacted at 230° C. at normal pressures for 8 hours, and subsequently at reduced pressures of 10 to 15 mmHg for 4 hours. After further adding 1% by mol (based on all the resin components) of trimellitic anhydride to the flask, the flask contents were reacted at 180° C. at normal pressures for 3 hours. Thus, an amorphous polyester resin B1 was prepared.

Preparation Examples B2 and B3

Synthesis of Amorphous Polyester Resins B2 and B3

The procedure for preparing the amorphous polyester resin B1 was repeated except for changing the diol components and the dicarboxylic acid components as described in Table 2. Thus, amorphous polyester resins B2 and B3 were prepared.

In Table 2, each numeral in a parenthesis indicates a blending ratio (% by mol).

TABLE 2

| | Diols | Dicarboxylic Acids | OH/COOH |
|---|---|---|---|
| B1 | BisA-EO/BisA-PO (40/60) | Terephthalic acid/Adipic acid (85/15) | 1.3 |
| B2 | BisA-EO/BisA-PO (85/15) | Isophthalic acid/Adipic acid (80/20) | 1.3 |

TABLE 2-continued

| | Diols | Dicarboxylic Acids | OH/COOH |
|---|---|---|---|
| B3 | BisA-EO/BisA-PO (75/25) | Isophthalic acid/Adipic acid (70/30) | 1.3 |

Preparation Example C1

Synthesis of Crystalline Polyester Resin C1

A 5-L four-neck flask equipped with a nitrogen inlet tube, a dewatering tube, a stirrer, and a thermocouple, sebacic acid and ethylene glycol were contained, such that the molar ratio (OH/COOH) of hydroxyl groups to carboxyl groups became 0.9. After adding 500 ppm (based on the resin components) of titanium tetraisopropoxide to the flask, the flask contents were reacted at 180° C. for 10 hours, thereafter at 200° C. for 3 hours, and further under a pressure of 8.3 kPa for 2 hours. Thus, a crystalline polyester resin C1 was prepared.

Preparation Examples C2 and C3

Synthesis of Crystalline Polyester Resins C2 and C3

The procedure for preparing the crystalline polyester resin C was repeated except for changing the diol components and the dicarboxylic acid components as described in Table 3. Thus, crystalline polyester resins C2 and C3 were prepared.

TABLE 3

| | Diols | Dicarboxylic Acids | OH/COOH |
|---|---|---|---|
| C1 | Ethylene glycol (100) | Sebacic acid (100) | 0.9 |
| C2 | 1,6-Hexanediol (100) | Sebacic acid (100) | 0.9 |
| C3 | 1,6-Hexanediol (100) | Dodecanedioic acid (100) | 0.9 |

Example 1

Preparation of Master Batch

First, 1,200 parts of water, 500 parts of a carbon black (PRINTEX 35 available from Degussa, having a DBP oil absorption of 42 mL/100 mg and a pH of 9.5), and 500 parts of the amorphous polyester resin B1 were mixed with a HENSCHEL MIXER (available from NIPPON COKE & ENGINEERING CO., LTD.). The mixture was kneaded with a double roll at 150° C. for 30 minutes, thereafter rolled to cool, and pulverized with a pulverizer. Thus, a master batch 1 was prepared.

Preparation of Wax Dispersion Liquid

In a vessel equipped with a stirrer and a thermometer, 300 parts of a paraffin wax (HNP-9 available from NIPPON SEIRO CO., LTD., a hydrocarbon wax having a melting point of 75° C.), serving as a release agent 1, 150 parts of a wax dispersant (RSWD-A available from Sanyo Chemical Industries, Ltd.), and 1,800 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a wax dispersion liquid 1 was prepared.

Preparation of Crystalline Polyester Resin Dispersion Liquid

In a vessel equipped with a stirrer and a thermometer, 308 parts of the crystalline polyester resin C1 and 1,900 parts of ethyl acetate were contained and heated to 80° C. while being stirred, maintained at 80° C. for 5 hours, and cooled to 30° C. over a period of 1 hour. The resulting liquid was thereafter subjected to a dispersion treatment using a bead mill (ULTRAVISCOMILL available from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Thus, a crystalline polyester resin dispersion liquid C1 was prepared.

Preparation of Oil Phase

In a vessel, 190 parts of the wax dispersion liquid 1, 32 parts of the prepolymer A1, 290 parts of the crystalline polyester resin dispersion liquid C1, 65 parts of the amorphous polyester resin B1, 100 parts of the master batch 1, 0.2 parts of the ketimine compound 1, and 11.3 parts of the layered inorganic mineral A were mixed with a TK HOMOMIXER (available from PRIMIX Corporation) at a revolution of 7,000 rpm for 60 minutes. Thus, an oil phase 1 was prepared.

Preparation of Fine Particle Dispersion Liquid

In a reaction vessel equipped with a stirrer and a thermometer, 683 parts of water, 11 parts of a sodium salt of a sulfate of ethylene oxide adduct of methacrylic acid (ELEMINOL RS-30 available from Sanyo Chemical Industries, Ltd.), 138 parts of styrene, 138 parts of methacrylic acid, and 1 part of ammonium persulfate were contained and stirred at a revolution of 400 rpm for 15 minutes. Thus, a white emulsion was obtained. The white emulsion was heated to 75° C. and subjected to a reaction for 5 hours. A 1% aqueous solution of ammonium persulfate in an amount of 30 parts was further added to the emulsion, and the mixture was aged at 75° C. for 5 hours. Thus, a fine particle dispersion liquid 1 was prepared, that was an aqueous dispersion of a vinyl resin (i.e., a copolymer of styrene, methacrylic acid, and a sodium salt of a sulfate of ethylene oxide adduct of methacrylic acid).

The fine particles in the fine particle dispersion liquid 1 had a volume average particle diameter of 0.14 μm when measured by an instrument LA-920 (available from HORIBA, Ltd.). A part of the fine particle dispersion liquid 1 was dried to isolate the resin.

Preparation of Aqueous Phase

An aqueous phase 1 was prepared by stir-mixing 990 parts of water, 83 parts of the fine particle dispersion liquid 1, 37 parts of a 48.5% aqueous solution of sodium dodecyl diphenyl ether disulfonate (ELEMINOL MON-7 available from Sanyo Chemical Industries, Ltd.), and 90 parts of ethyl acetate. The aqueous phase 1 was a milky white liquid.

Emulsification and Solvent Removal

In a vessel, 700.2 parts of the oil phase 1 and 1,200 parts of the aqueous phase 1 were contained and mixed with a TK HOMOMIXER at a revolution of 8,000 rpm for 20 minutes. Thus, an emulsion slurry 1 was prepared.

The emulsion slurry 1 was contained in a vessel equipped with a stirrer and a thermometer and subjected to solvent removal at 30° C. for 8 hours and subsequently to aging at 45° C. for 4 hours. Thus, a dispersion slurry 1 was obtained.

Washing and Drying

After 100 parts of the dispersion slurry 1 was filtered under reduced pressures, (1) 100 parts of ion-exchange water was added to the filter cake and mixed therewith using a TK HOMOMIXER at a revolution of 12,000 rpm for 10 minutes, followed by filtration; (2) 100 parts of a 10% aqueous solution of sodium hydroxide was added to the filter cake of (1) and mixed therewith using a TK HOMOMIXER at a revolution of 12,000 rpm for 30 minutes, followed by filtration under reduced pressures; (3) 100 parts of a 10% aqueous solution of hydrochloric was added to the filter cake of (2) and mixed therewith using a TK HOMOMIXER at a revolution of 12,000 rpm for 10 minutes, followed by filtration; and (4) 300 parts of ion-exchange water was added to the filter cake of (3) and mixed therewith using a TK HOMOMIXER at a revolution of 12,000 rpm for 10 minutes, followed by filtration. These operations (1) to (4) were repeated twice, thus obtaining a filter cake 1.

The filter cake 1 was dried by a circulating air dryer at 45° C. for 48 hours and then filtered with a mesh having an opening of 75 μm. Thus, a toner 1 was prepared.

Example 2

The procedure in Example 1 was repeated except for replacing the crystalline polyester resin C1 with the crystalline polyester resin C2. Thus, a toner of Example 2 was prepared.

Example 3

The procedure in Example 1 was repeated except for replacing the layered inorganic mineral A with the layered inorganic mineral B. Thus, a toner of Example 3 was prepared.

Example 4

The procedure in Example 2 was repeated except for replacing the layered inorganic mineral A with the layered inorganic mineral C. Thus, a toner of Example 4 was prepared.

Example 5

The procedure in Example 1 was repeated except for replacing the layered inorganic mineral A with the layered inorganic mineral D. Thus, a toner of Example 5 was prepared.

Example 6

The procedure in Example 1 was repeated except for replacing the layered inorganic mineral A with the layered inorganic mineral E. Thus, a toner of Example 6 was prepared.

Example 7

The procedure in Example 1 was repeated except for changing the amount of the layered inorganic mineral A from 11.3 parts to 10.0 parts in preparing the oil phase. Thus, a toner of Example 7 was prepared.

Example 8

The procedure in Example 7 was repeated except for replacing the layered inorganic mineral A with the layered inorganic mineral F. Thus, a toner of Example 8 was prepared.

Example 9

The procedure in Example 7 was repeated except for replacing the layered inorganic mineral A with the layered inorganic mineral G. Thus, a toner of Example 9 was prepared.

Example 10

The procedure in Example 1 was repeated except for replacing the prepolymer A1, the amorphous polyester resin B1, and the crystalline polyester resin C1 with the prepolymer A2, the amorphous polyester resin B2, and the crystalline polyester resin C3, respectively. Thus, a toner of Example 10 was prepared.

Example 11

The procedure in Example 1 was repeated except for replacing the prepolymer A1 and the amorphous polyester resin B1 with the prepolymer A3 and the amorphous polyester resin B2, respectively. Thus, a toner of Example 11 was prepared.

Example 12

The procedure in Example 1 was repeated except for replacing the amorphous polyester resin B1 with the amorphous polyester resin B2, and omitting the crystalline polyester resin C1. Thus, a toner of Example 12 was prepared.

Comparative Example 1

The procedure in Example 1 was repeated except for replacing the prepolymer A1, the amorphous polyester resin B1, the crystalline polyester resin C1, and the layered inorganic mineral A with the prepolymer A4, the amorphous polyester resin B3, the crystalline polyester resin C3, and CLAYTONE® APA (available from BYK Additives & Instruments) respectively, and further adding the following processes: adding a 1% by mass methanol solution of FTERGENT 310 (available from NEOS COMPANY LIMITED) to the filter cake having been washed, so that 0.1% by mass of FTERGENT 310 serving as a charge controlling agent was deposited on the toner, and thereafter 300 parts of water was mixed therein using a TK HOMOMIXER at a revolution of 12,000 rpm for 10 minutes, followed by filtration. Thus, a toner of Comparative Example 1 was prepared.

Comparative Example 2

The procedure in Example 11 was repeated except for replacing the prepolymer A3 and the layered inorganic mineral A with the prepolymer A5 and a modified layered inorganic mineral (CLAYTONE® APA), respectively. Thus, a toner of Comparative Example 2 was prepared.

Comparative Example 3

The procedure in Example 1 was repeated except for replacing the crystalline polyester resin C1 and the layered inorganic mineral A with the crystalline polyester resin C3 and the layered inorganic mineral H, respectively. Thus, a toner of Comparative Example 3 was prepared.

Comparative Example 4

The procedure in Comparative Example 2 was repeated except for further adding 7 parts of FTERGENT 209F (available from NEOS COMPANY LIMITED) in preparing the oil phase. Thus, a toner of Comparative Example 4 was prepared.

X-ray Photoelectron Spectroscopy (XPS)

The content rate (atomic %) of fluorine atom at the surface of the toner was determined by X-ray photoelectron spectroscopy (XPS) using the below-described measuring instrument under the below-described conditions.

An aluminum pan was filled with a sample and fixed to a sample holder with a carbon sheet. A surface atom concentration was calculated using relative sensitivity coefficients provided by Kratos Analytical Ltd.

Measuring instrument: AXIS-ULTRA available from Kratos Analytical Ltd.

Measuring light source: AI (monochrome meter)

Measuring power: 105 W (15 kV, 7 mA)

Analysis area: 900 μm×600 μm

Measuring mode: Hybrid mode

Pass energy: 160 eV (wide scan), 40 eV (narrow scan)

Energy step: 1.0 eV (wide scan), 0.2 eV (narrow scan)

Relative sensitivity coefficients: provided by Kratos Analytical Ltd.

X-ray Fluorescence Analysis (XRF)

The content rate (weight %) of fluorine atom in the toner was determined by X-ray fluorescence analysis (XRF) using the below-described measuring instrument under the below-described conditions.

First, 3.00 g of a sample was pelletized into a pellet having a diameter of 3 mm and a thickness of 2 mm.

The pellet was subjected to a quantitative analysis by an X-ray fluorescence analyzer to measure the content of fluorine atom. In the measurement, a fluorine standardized sample (available from Rigaku Corporation) was used to calculate the content with correction.

Measuring instrument: ZSX-100e available from Rigaku Corporation

X-ray bulb: Rh

X-ray tube voltage: 40 kV

X-ray tube current: 20 mA

Glass Transition Temperature (Tg)

Glass transition temperature (Tg) was measured with a DSC (differential scanning calorimeter) system (Q-200 available from TA Instruments) as follows.

First, about 5.0 mg of a toner was put in an aluminum sample container. The sample container was put on a holder unit and set in an electric furnace. The sample container was heated from −80° C. to 150° C. at a temperature rising rate of 10° C./min ("first heating") in nitrogen atmosphere. The sample container was thereafter cooled from 150° C. to −80° C. at a temperature falling rate of 10° C./min and heated to 150° C. again at a temperature rising rate of 10° C./min ("second heating"). In each of the first heating and the second heating, a DSC curve was obtained by the differential scanning calorimeter (Q-200 available from TA Instruments).

The obtained DSC curves were analyzed with analysis program installed in Q-200. By selecting the DSC curve obtained in the first heating, a glass transition temperature in the first heating was determined. Similarly, by selecting the DSC curve obtained in the second heating, a glass transition temperature in the second heating was determined.

Evaluations

Developers were prepared with the above toners in the following manner and subjected to the following evaluations. The results are shown in Tables 4 and 5.

Preparation of Carrier

A resin layer coating liquid was prepared by dispersing 100 parts of a silicone resin (organo straight silicone), 5 parts of γ-(2-aminoethyl) aminopropyl trimethoxysilane, and 10 parts of a carbon black in 100 parts of toluene by a homomixer for 20 minutes. The resin layer coating liquid was applied to the surfaces of 1,000 parts of spherical magnetite having an average particle diameter of 50 μm by a fluidized bed coating device. Thus, a carrier was prepared.

Preparation of Developer

Each toner in an amount of 5 parts and the carrier in an amount of 95 parts were mixed. Thus, a developer was prepared.

Evaluation of Chargeability

Each two-component developer in an amount of 6 g was sealed in a metallic cylinder and stirred at a stirring velocity of 280 rpm. The charge amount of the developer was measured by a blow-off method. The measurement was performed after the stirring time reached 15 seconds (TA15), 60 seconds (TA60), and 600 seconds (TA600). As a carrier in the two-component developers, TEFV200/300 (available from Powdertech Co., Ltd.) was used. Chargeability was evaluated based on the following criteria.

Evaluation Criteria

A: The absolute charge amount was 38 Q/M or more.

B: The absolute charge amount was 35 Q/M or more and less than 38 Q/M.

C: The absolute charge amount was 32 Q/M or more and less than 35 Q/M.

D: The absolute charge amount was less than 32 Q/M.

Evaluation of Low-temperature Fixability

A copy test was performed by a copier MF2200 (available from Ricoh Co., Ltd.) employing a TEFLON® roller as the fixing roller, the fixing unit of which had been modified, using a paper TYPE 6200 (available from Ricoh Co., Ltd.).

In the test, the cold offset temperature (lower-limit fixable temperature) was determined by varying the fixing temperature.

The lower-limit fixable temperature was evaluated while setting the sheet feed linear velocity to 120 to 150 mm/sec, the surface pressure to 1.2 kgf/cm$^2$, and the nip width to 3 mm. Low-temperature fixability was evaluated based on the following criteria.

Evaluation Criteria

A: The cold offset temperature was less than 110° C.

B: The cold offset temperature was 110° C. or more and less than 120° C.

C: The cold offset temperature was 120° C. or more and less than 130° C.

D: The cold offset temperature was 130° C. or more.

Evaluation of Heat-resistant Storage Stability

Each toner was stored at 50° C. for 8 hours and thereafter sieved with a 42 mesh for 2 minutes. The residual rate of toner particles remaining on the mesh was measured. The smaller the residual rate, the better the heat-resistant storage stability.

Heat-resistant storage stability was evaluated based on the following criteria.

Evaluation Criteria

A: The residual rate was less than 10%.

B: The residual rate was 10% or more and less than 25%.

C: The residual rate was 25% or more and less than 35%.

D: The residual rate was 35% or more.

Comprehensive Judgment

Comprehensive judgment was performed based on the following criteria.

Evaluation Criteria

A: One or more of the evaluation results ranked A, and none of the evaluation results ranked C or D.

B: One or less of the evaluation results ranked C, and none of the evaluation results ranked D.

C: Three or less of the evaluation results ranked C, and none of the evaluation results ranked D.

D: Four or more of the evaluation results ranked C, or at least one of the evaluation results ranked D.

TABLE 4

| | XPS [atomic %] | XRF [weight %] | XPS/XRF [–] | Tg1st [° C.] | TA15 [–Q/M] | TA60 [–Q/M] | TA600 [–Q/M] |
|---|---|---|---|---|---|---|---|
| Example 1 | 0.2 | 0.02 | 10.0 | 48 | 35 | 38 | 35 |
| Example 2 | 0.3 | 0.02 | 15.0 | 48 | 35 | 38 | 35 |
| Example 3 | 0.8 | 0.13 | 6.2 | 48 | 40 | 40 | 39 |
| Example 4 | 0.2 | 0.01 | 20.0 | 48 | 35 | 38 | 32 |
| Example 5 | 0.8 | 0.14 | 5.7 | 48 | 40 | 39 | 38 |
| Example 6 | 0.9 | 0.15 | 6.0 | 48 | 40 | 41 | 39 |
| Example 7 | 0.1 | 0.01 | 10.0 | 48 | 32 | 36 | 32 |
| Example 8 | 0.6 | 0.06 | 10.0 | 48 | 37 | 39 | 36 |
| Example 9 | 0.7 | 0.07 | 10.0 | 48 | 37 | 39 | 36 |
| Example 10 | 0.2 | 0.02 | 10.0 | 52 | 35 | 38 | 35 |
| Example 11 | 0.2 | 0.02 | 10.0 | 18 | 35 | 38 | 36 |
| Example 12 | 0.2 | 0.02 | 10.0 | 48 | 35 | 38 | 35 |
| Comparative Example 1 | 4.5 | 0.06 | 75.0 | 51 | 39 | 35 | 31 |
| Comparative Example 2 | 0 | 0 | — | 30 | 28 | 31 | 30 |
| Comparative Example 3 | 0.8 | 0.17 | 4.7 | 51 | 37 | 39 | 37 |
| Comparative Example 4 | 1.6 | 0.06 | 26.7 | 45 | 34 | 37 | 37 |

TABLE 5

| | TA15 | TA60 | TA600 | Lower-limit Fixable Temp. | Heat-resistant Storage Stability | Comprehensive Judgement |
|---|---|---|---|---|---|---|
| Example 1 | B | A | B | A | B | A |
| Example 2 | B | A | B | A | B | A |
| Example 3 | A | A | A | C | A | B |
| Example 4 | B | A | C | B | C | C |
| Example 5 | A | A | A | C | A | B |
| Example 6 | A | A | A | C | A | B |
| Example 7 | C | B | C | A | C | C |
| Example 8 | B | A | B | B | B | A |
| Example 9 | B | A | B | B | B | A |
| Example 10 | B | A | B | C | B | B |
| Example 11 | B | A | B | A | C | B |
| Example 12 | B | A | B | C | A | B |
| Comparative Example 1 | A | B | D | D | A | D |
| Comparative Example 2 | D | D | D | A | D | D |
| Comparative Example 3 | B | A | B | D | B | D |
| Comparative Example 4 | C | B | B | D | C | D |

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner comprising:

a resin; and a fluorine-containing component, wherein the toner satisfies the following formula:

$$5.0 \leq F_{XPS}/F_{XRF} \leq 25.0$$

where $F_{XPS}$ (atomic %) represents a content rate of fluorine atom in the toner determined by X-ray photoelectron spectroscopy (XPS) and $F_{XRF}$ (weight %) represents another content rate of fluorine atom in the toner determined by X-ray fluorescence analysis (XRF), wherein the content rate $F_{XPS}$ (atomic %) of fluorine atom in the toner determined by X-ray photoelectron spectroscopy (XPS) is in the range of from 0.2 to 0.8 atomic %.

2. The toner of claim 1, wherein the toner further satisfies the following formula: $6.0 \leq F_{XPS}/F_{XRF} \leq 15.0$.

3. The toner of claim 1, wherein the content rate $F_{XRF}$ (weight %) of fluorine atom in the toner determined by X-ray fluorescence analysis (XRF) is in the range of from 0.02 to 0.07 weight %.

4. The toner of claim 1, wherein the toner has a glass transition temperature (Tg1st), measured in a first heating of differential scanning calorimetry (DSC), in the range of from 20° C. to 50° C.

5. The toner of claim 1, wherein the resin comprises a crystalline polyester resin having an infrared absorption spectrum having an absorption based on δCH (out-of-plane vibration) of olefin at a wavelength of 965±10 $cm^{-1}$ or 990±10 $cm^{-1}$.

6. A developer comprising:

the toner of claim 1; and a carrier.

7. An image forming apparatus comprising:

an electrostatic latent image bearer;

an electrostatic latent image forming device configured to form an electrostatic latent image on the electrostatic latent image bearer; and a developing device containing the toner of claim 1, configured to develop the electrostatic latent image on the electrostatic latent image bearer into a toner image with the toner.

8. The toner of claim 1, wherein the fluorine-containing component comprises a fluorine-modified layered inorganic material, which is a layered inorganic material treated with a fluorine-containing compound, wherein the layered inorganic material comprises at least one inorganic mineral selected from the group consisting of montmorillonite, bentonite, hectorite, attapulgite, and sepiolite, and the fluorine-containing compound comprises a silane coupling agent having a fluoroalkyl group.

9. The toner of claim 8, wherein a content of the fluorine-containing compound in the fluorine-modified layered inorganic mineral is from 2 to 50 parts by mass, based on 100 parts by mass of the layered inorganic mineral.

10. The toner of claim 8, wherein a content of the fluorine-containing compound in the fluorine-modified layered inorganic mineral is from 4 to 40 parts by mass, based on 100 parts by mass of the layered inorganic mineral.

11. A toner comprising:

a resin; and a fluorine-containing component, wherein the toner satisfies the following formula:

$$5.0 \leq F_{XPS}/F_{XRF} \leq 25.0$$

where $F_{xps}$ (atomic %) represents a content rate of fluorine atom in the toner determined by X-ray photoelectron spectroscopy (XPS) and F (weight %) represents another content rate of fluorine atom in the toner determined by X-ray fluorescence analysis (XRF), wherein the content rate $F_{XRF}$ (weight %) of fluorine atom in the toner determined by X-ray fluorescence analysis (XRF) is in the range of from 0.02 to 0.07 weight %.

12. A toner comprising:

a resin; and a fluorine-containing component, wherein the toner satisfies the following formula:

$$5.0 \leq F_{XPS}/F_{XRF} \leq 25.0$$

where $F_{XPS}$ (atomic %) represents a content rate of fluorine atom in the toner determined by X-ray photoelectron spectroscopy (XPS) and $F_{XRF}$ (weight %) represents another content rate of fluorine atom in the toner determined by X-ray fluorescence analysis (XRF), wherein the fluorine-containing component comprises a fluorine-modified layered inorganic material, which is a layered inorganic material treated with a fluorine-containing compound, wherein the layered inorganic material comprises at least one inorganic mineral selected from the group consisting of montmorillonite, bentonite, hectorite, attapulgite, and sepiolite, and the fluorine-containing compound comprises a silane coupling agent having a fluoroalkyl group.

13. The toner of claim 12, wherein a content of the fluorine-containing compound in the fluorine-modified layered inorganic mineral is from 2 to 50 parts by mass, based on 100 parts by mass of the layered inorganic mineral.

14. The toner of claim 12, wherein a content of the fluorine-containing compound in the fluorine-modified layered inorganic mineral is from 4 to 40 parts by mass, based on 100 parts by mass of the layered inorganic mineral.

15. A developer comprising:

the toner of claim 11; and a carrier.

16. An image forming apparatus comprising:

an electrostatic latent image bearer;

an electrostatic latent image forming device configured to form an electrostatic latent image on the electrostatic latent image bearer; and a developing device containing the toner of claim 11, configured to develop the electrostatic latent image on the electrostatic latent image bearer into a toner image with the toner.

17. A developer comprising:

the toner of claim 12; and a carrier.

18. An image forming apparatus comprising:

an electrostatic latent image bearer;

an electrostatic latent image forming device configured to form an electrostatic latent image on the electrostatic latent image bearer; and a developing device containing the toner of claim 12, configured to develop the electrostatic latent image on the electrostatic latent image bearer into a toner image with the toner.

* * * * *